US009897377B2

(12) United States Patent
Beaumont

(10) Patent No.: US 9,897,377 B2
(45) Date of Patent: Feb. 20, 2018

(54) EXHAUST SAFETY SYSTEM

(71) Applicant: BOEMAR INC., Tortola (VG)

(72) Inventor: Bart Donald Beaumont, San Diego, CA (US)

(73) Assignee: BOEMAR INC., Road Town, Tortola (VG)

( * ) Notice: Subject to any disclaimer, the term of this patent is extended or adjusted under 35 U.S.C. 154(b) by 405 days.

(21) Appl. No.: 13/781,517

(22) Filed: Feb. 28, 2013

(65) Prior Publication Data

US 2013/0219735 A1 Aug. 29, 2013

Related U.S. Application Data

(60) Provisional application No. 61/604,420, filed on Feb. 28, 2012.

(51) Int. Cl.

| | |
|---|---|
| ***F26B 21/06*** | (2006.01) |
| ***F26B 3/00*** | (2006.01) |
| ***F26B 21/00*** | (2006.01) |
| ***D06F 58/20*** | (2006.01) |
| ***D06F 58/22*** | (2006.01) |
| ***D06F 58/28*** | (2006.01) |

(52) U.S. Cl.

CPC ..... *F26B 21/003* (2013.01); *D06F 58/20* (2013.01); *D06F 58/22* (2013.01); *D06F 58/28* (2013.01); *D06F 2058/2858* (2013.01); *D06F 2058/2864* (2013.01)

(58) Field of Classification Search

CPC .... F26B 21/003; F26B 11/028; F26B 25/007; D06F 58/22; D06F 2058/2864

USPC ..... 34/82, 480

See application file for complete search history.

(56) References Cited

U.S. PATENT DOCUMENTS

| | | | | |
|---|---|---|---|---|
| 2,422,825 | A | 6/1947 | Davis, Jr. | |
| 2,577,104 | A | 12/1951 | Butler | |
| 2,825,148 | A | 3/1958 | Olson | |
| 2,941,308 | A | 6/1960 | Cobb et al. | |
| 2,959,044 | A | 11/1960 | Stone | |
| 3,081,554 | A | 3/1963 | Long | |
| 3,487,624 | A * | 1/1970 | Tignanelli | B01D 46/10 34/82 |
| 3,639,998 | A | 2/1972 | Mason | |
| 3,748,746 | A | 7/1973 | Robandt | |
| 4,115,485 | A | 9/1978 | Genessi | |
| 4,689,896 | A | 9/1987 | Narang | |
| 4,700,492 | A * | 10/1987 | Werner et al. | 34/403 |
| 4,969,276 | A | 11/1990 | Walsh | |
| 5,097,606 | A | 3/1992 | Harmelink et al. | |
| 5,129,922 | A | 7/1992 | Kaiser | |
| 5,272,781 | A | 12/1993 | Bastin et al. | |
| 5,443,541 | A | 8/1995 | St. Louis | |
| 5,560,124 | A | 10/1996 | Hart et al. | |

(Continued)

FOREIGN PATENT DOCUMENTS

| | | |
|---|---|---|
| AU | 2007231878 A1 | 11/2007 |
| CA | 461915 | 12/1949 |

(Continued)

*Primary Examiner* — John McCormack

(74) *Attorney, Agent, or Firm* — Hill & Schumacher

(57) ABSTRACT

An exhaust system includes a filter; and a fan downstream for the filter whereby activating the fan clears the filter. The exhaust system may form part of a lint collection system that is for attachment to a dryer.

18 Claims, 26 Drawing Sheets

(56) References Cited

U.S. PATENT DOCUMENTS

| | | | | |
|---|---|---|---|---|
| 5,628,122 | A | 5/1997 | Spinardi | |
| 5,706,588 | A | 1/1998 | Dausch et al. | |
| 5,743,357 | A | 4/1998 | Elkhart | |
| 6,220,092 | B1 | 4/2001 | Catbagan | |
| 6,393,725 | B1 | 5/2002 | Smith et al. | |
| 6,671,977 | B2 | 1/2004 | Beaumont | |
| 8,955,232 | B2 * | 2/2015 | Cunningham | 34/87 |
| 2002/0023368 | A1 * | 2/2002 | Beaumont | 34/79 |
| 2007/0095027 | A1 * | 5/2007 | Liva | B01D 46/0065 55/301 |
| 2010/0146812 | A1 * | 6/2010 | Ahn | D06F 58/22 34/480 |
| 2011/0277334 | A1 * | 11/2011 | Lee | D06F 39/008 34/73 |

FOREIGN PATENT DOCUMENTS

| | | | |
|---|---|---|---|
| CA | 470988 | | 1/1951 |
| CA | 1158930 | | 12/1983 |
| CA | 2024870 | | 12/1993 |
| DE | 3930727 | A1 | 3/1991 |
| EP | 0312072 | B1 | 3/1993 |
| WO | 0204736 | A2 | 1/2002 |

* cited by examiner

EXHAUST SAFETY SYSTEM

CROSS REFERENCE TO RELATED PATENT APPLICATION

This patent application relates to U.S. Provisional Patent Application Ser. No. 61/604,420 filed on Feb. 28, 2012 entitled IMPROVED LINT COLLECTOR SYSTEM which is incorporated herein by reference in its entirety.

FIELD OF THE INVENTION

This invention relates to an exhaust safety system and in particular a dryer exhaust safety system that may be used with or without a filter cleaner, lint collector or booster fan and may be used in association with clothes dryers in single and multiple dwellings.

BACKGROUND OF THE INVENTION

It has long been recognized that lint poses a fire hazard in homes and in multi-unit dwellings whether they be high rises or low rises. Many systems have been suggested to address the lint problem but there are still many serious problems with the systems that have been previously proposed.

SUMMARY OF THE INVENTION

An exhaust system includes a filter; and a fan downstream for the filter whereby activating the fan clears the filter. The exhaust system may form part of a lint collection system that is for attachment to a dryer. Alternatively the exhaust system may be part of the dryer, either retrofit into the dryer or manufactured as part of the dryer.

The exhaust system may further include a flow meter and the fan may be activated responsive to a measurement from the flow meter being below a predetermined level.

The exhaust system may further include a pressure sensor and the fan may be activated responsive to a measurement from the pressure sensor being below a predetermined level.

The fan is manually activatable. The fan may be activated at predetermined times.

The exhaust system may further include a display. The display may include one of light indicators, and audio indicator and display screen and a combination thereof.

The exhaust system may further include sensors and the sensors may be chosen from a group consisting of flow meters, pressure sensors, temperatures sensors and water level sensors and a combination thereof.

The exhaust system may be operably connected to a dryer whereby if the sensors are outside of predetermined levels power to the dryer is interrupted.

The exhaust system may form part of a lint collection system. The lint collection system may include an upper and lower housing, the upper housing having and inlet and an outlet includes the exhaust system. The lower housing may be primed with water. A disposable liner may be used in the lower housing.

A receptacle may be provided proximate to the filter for receiving lint from the filter after the fan has been activated. The receptacle may be provided with water. The receptacle may be provided with a disposable liner.

The exhaust system may be located in an exhaust pipe insert. The exhaust pipe insert may include an elbow extending out from a general flow of the exhaust pipe insert and the exhaust system is located in the elbow.

Further features of the invention will be described or will become apparent in the course of the following detailed description.

BRIEF DESCRIPTION OF THE DRAWINGS

The invention will now be described by way of example only, with reference to the accompanying drawings, in which.

DETAILED DESCRIPTION OF THE INVENTION

Figure 1:
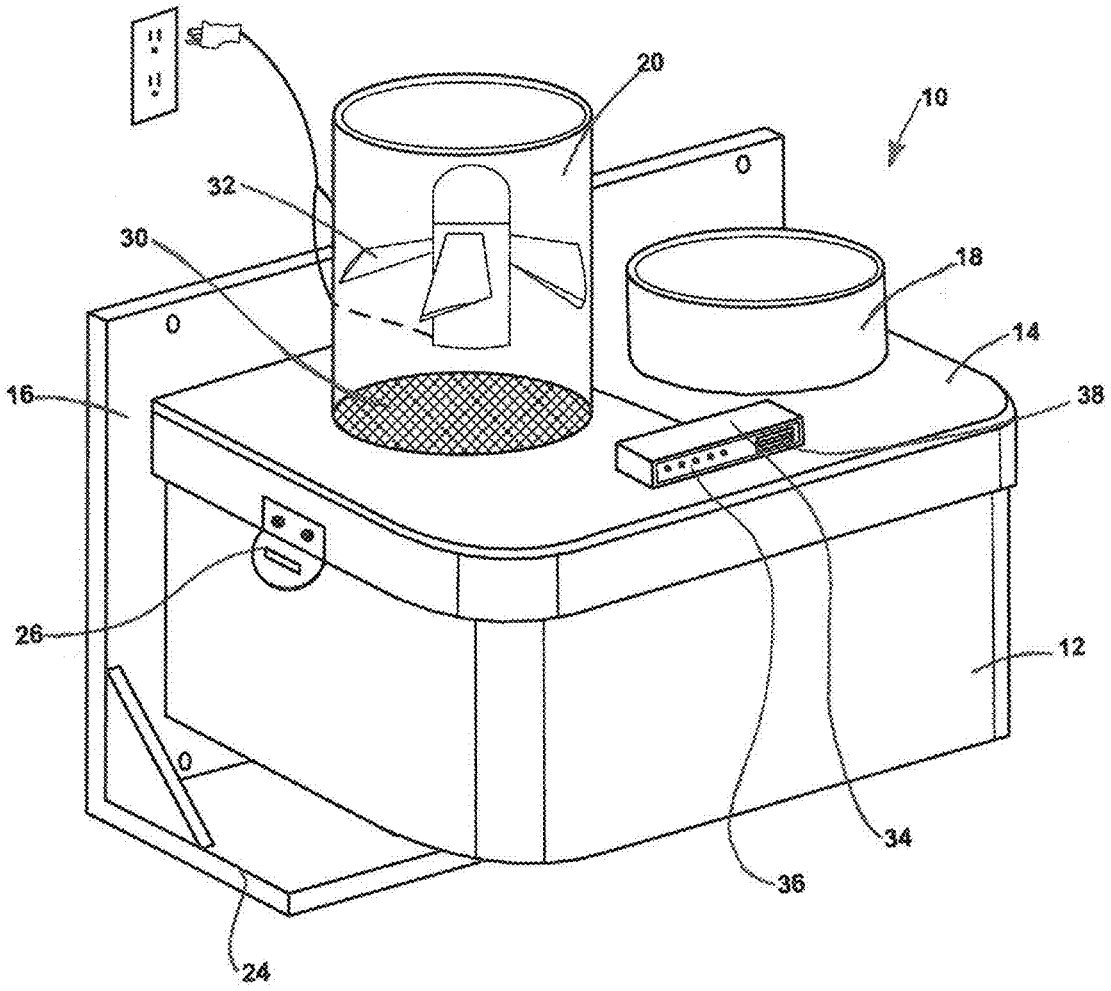
FIG. 1 is a perspective view of an embodiment of the improved lint collector system.
Figure 2:
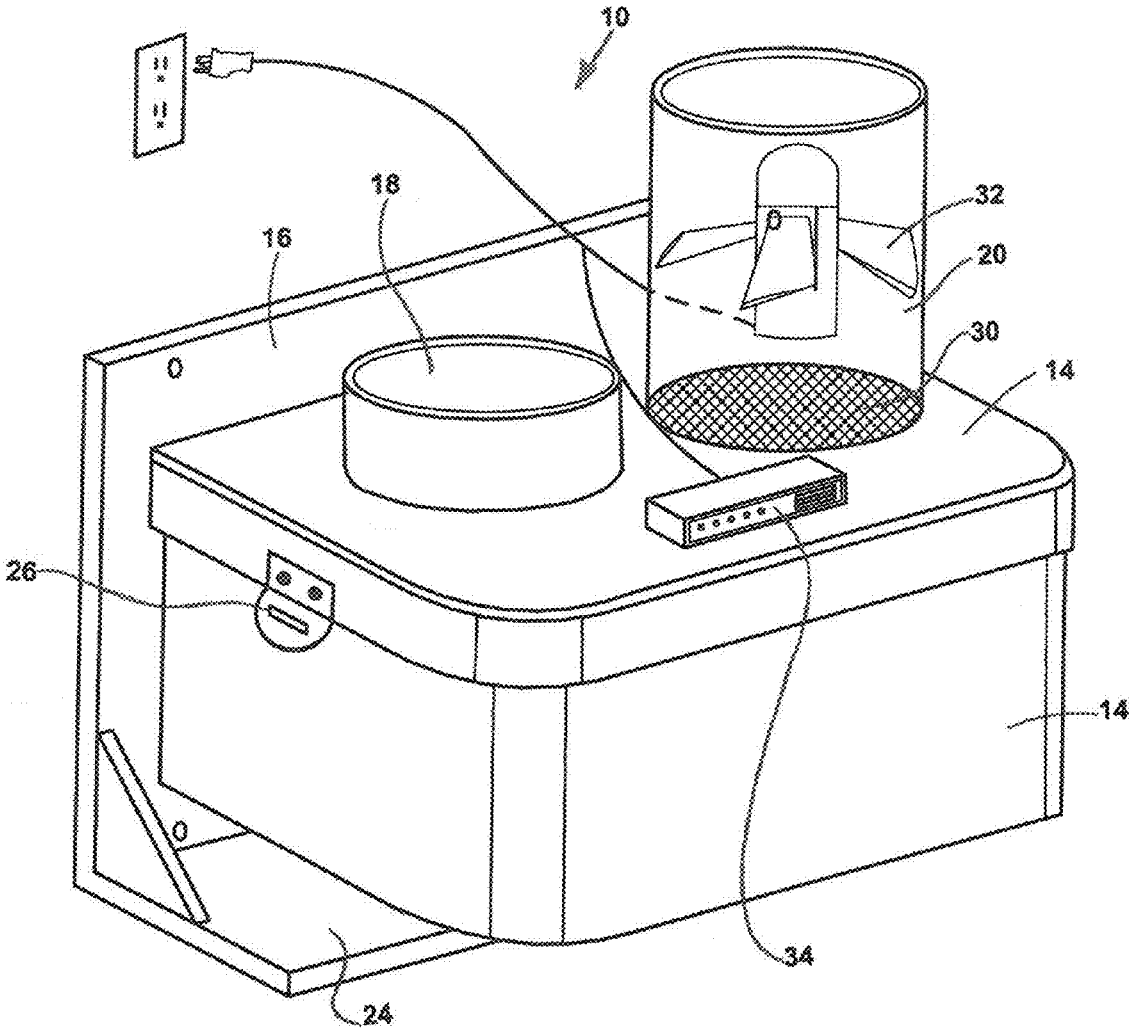
FIG. 2 is a perspective view of an alternate embodiment of the improved lint collector system, similar to that shown in FIG. 1 but showing the lint screen on an alternate side.

Referring to FIGS. 1 and 2 a lint collector system is shown generally at 10. The lint collector system 10 includes a lower housing 12, an upper housing 14 and a back bracket 16. Lower housing 12 is detachable and removable from upper housing 14.

Upper housing 14 has an inlet 18 and an outlet 20. The inlet can be arranged such that it is on the left hand side as shown in FIG. 1 or the right hand side as shown in FIG. 2. The diameter of each of inlet 18 and outlet 20 may be varied, but is most preferably of the same diameter as exhaust ducting passing from a clothes dryer 22 (shown in FIG. 10). In particular, each of inlet 18 and outlet 20 is of a diameter consistent with the flexible corrugated hose that is used with many clothes dryers. However, it will be understood that the diameter may be varied to accommodate a lint collector system 1 into an existing exhaust system from a clothes dryer.

Figure 10:
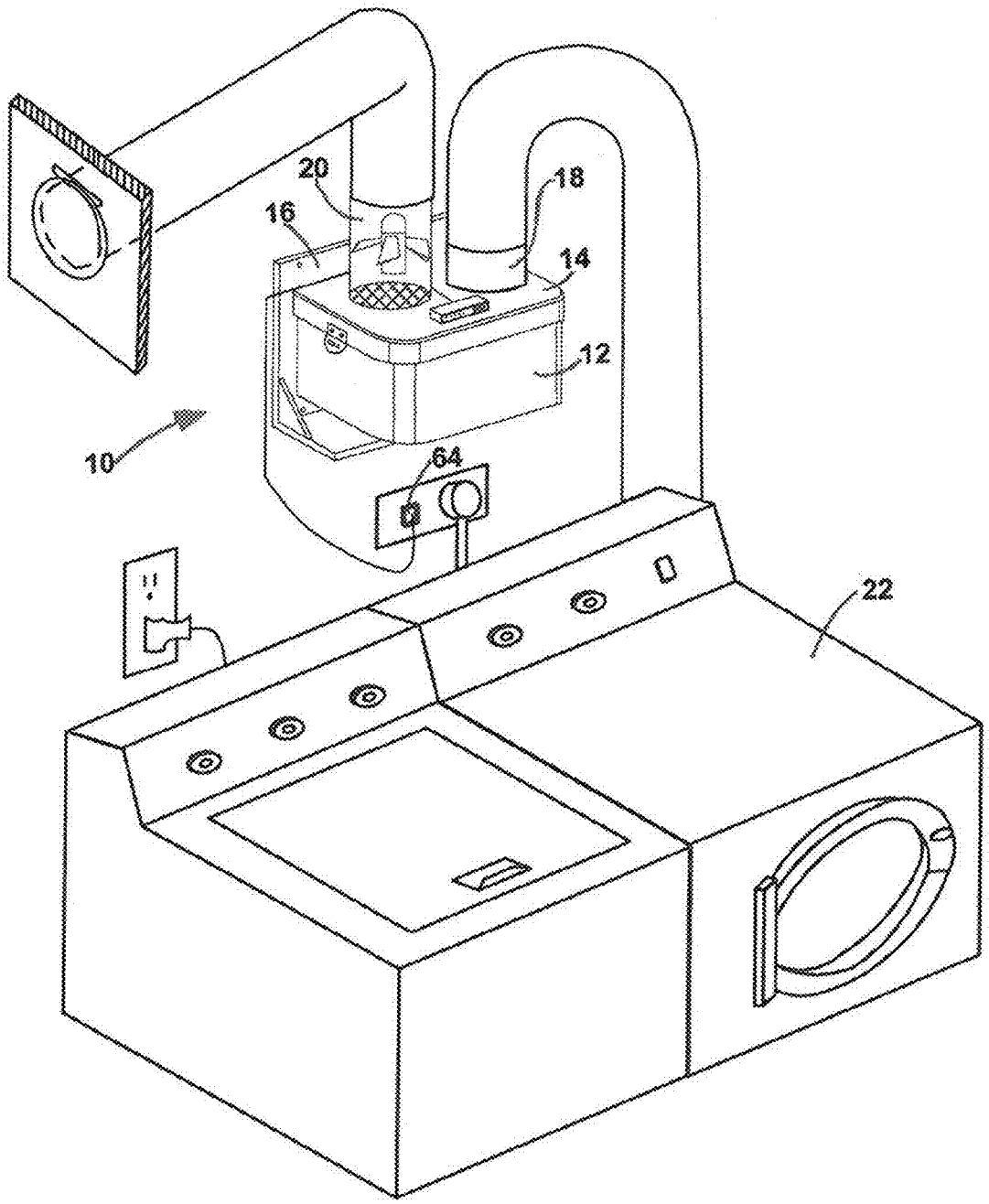
FIG. 10 is a perspective view of the lint collector system of FIG. 1 attached to a dryer with a low voltage plug enabling the lint collector system.

Back bracket 16 is attachable to a wall and typically would be attached above, behind or beside a clothes dryer 22 as shown in FIG. 10. Bracket 16 includes a shelf 24 which is spaced below the lower housing 12 where it is in position.

Lower housing 12 is separable from upper housing 14, and in normal use is attached to upper housing 14 by means of closure 26. It is understood that closure 26 may be of any type suitable for attachment of lower housing 12 to upper housing 14, while permitting separation of lower housing 12 from upper housing 14. Closures 26 may be provided on opposed ends of upper housing 14, such that lower housing 12 may be detached and lowered from upper housing 14 for the purpose of emptying. Upper housing 14 is provided with a foam tape 28 so that when lower housing 12 is attached thereto there is a good seal and the moisture from the lint from the dryer 22 generally remains therein.

Outlet 20 has a filter 30 positioned therein. Filter 30 is preferably made from a fine mesh so that it can trap as much lint as possible. In use typically the bulk of the lint will be "caught" in the lower housing 12 but in the event that some lint gets by the lower housing 12 it will be caught by the filter 30. Filter may be made of different materials such as nylon, steel, aluminium or polyester by way of example. Preferably filter 30 is removable so that it is easy to inspect and easy to replace.

Outlet 20 is also provided with fan 32 which is downstream from the filter 30. Fan 32 is for providing back pressure so that lint that has accumulated on the underside of filter 30 can be pushed off the filter and into lower housing 12 and thus clean the screen. Thus the fan allows the filter 30 to be essentially self-cleaning. Fan 32 may be activated in a number of ways. For example fan 32 may be active periodically through the drying cycle at predetermined times. Alternatively outlet 20 may have an airflow sensor and the fan 32 may be activated when the air flow drops below a predetermined amount. As further alternative it may be manually activated such that a user may activate the fan to produce back pressure at the end or beginning of each drying cycle.

Fan 32 may be a reversible fan such that it can be used to measure air flow when rotating in one direction and then used to clear filter 30 when activated in the other direction. Alternatively fan 32 may be used to increase air flow of the outgoing air in the outlet downstream of the filter 30.

Preferably, lint collector system 10 includes a display 34. Display 34 may include light indicators 36 operably connected to different sensors. Light indicators 36 by way of example may be LED or LCD. As well, display 34 may include an audio indicator 38. Referring to FIGS. 23 to 26 a variety of different configurations of the display 34 are shown which include different combinations of one or more light indicators 36, audio indicators 38 or a display screen 40.

Figure 3:
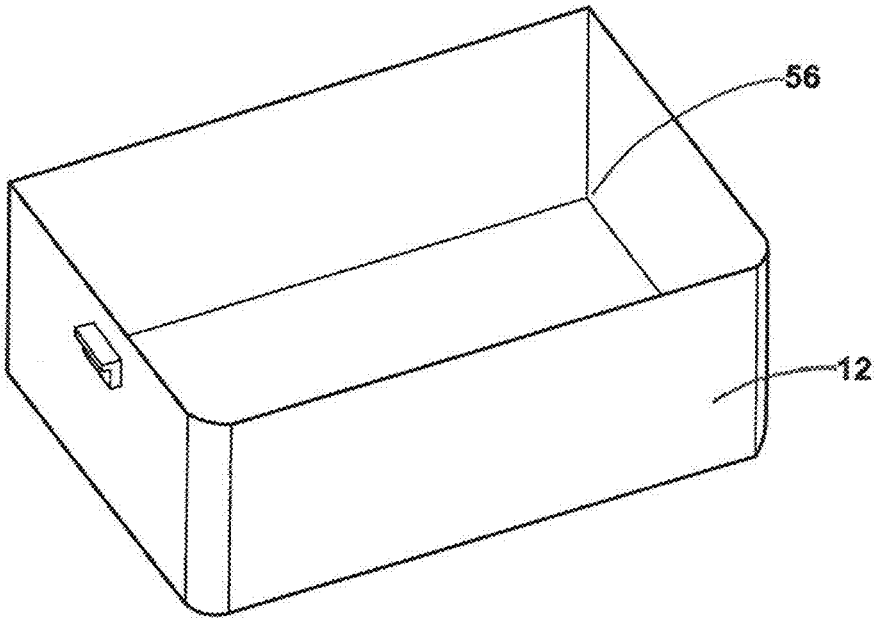
FIG. 3 is perspective view of lower housing used in lint collector system of FIGS. 1 and 2.
Figure 4:
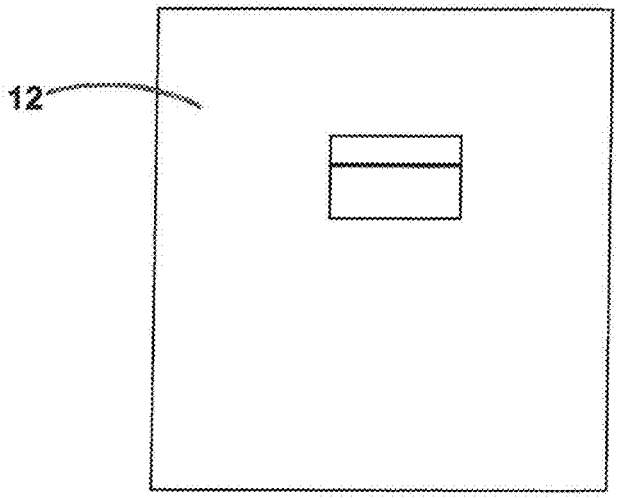
FIG. 4 is an end view of the lower housing of lint collector system shown in FIG. 3.
Figure 5:
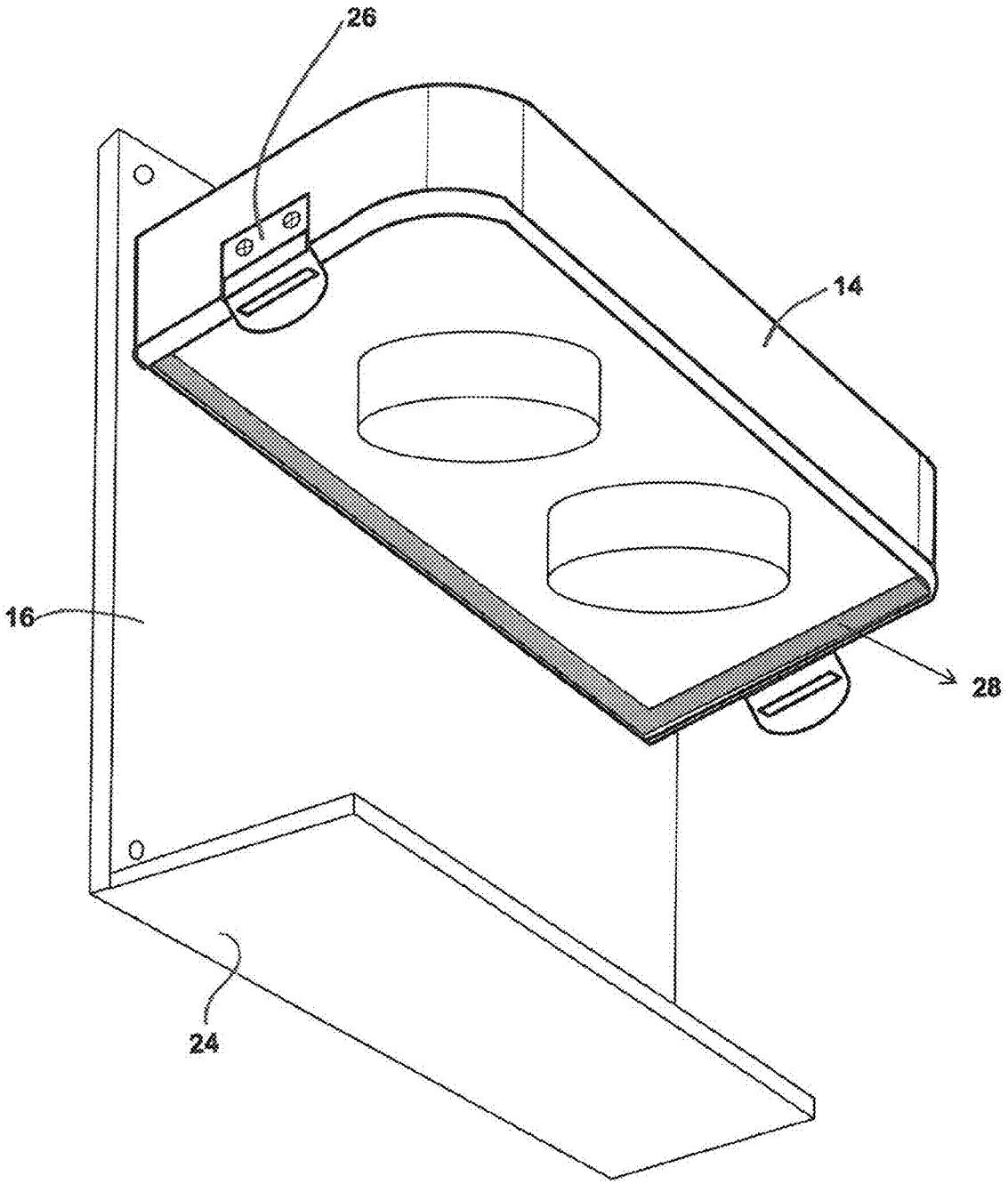
FIG. 5 is a perspective view of upper housing and bracket of lint collector system of FIGS. 1 and 2.
Figure 6:
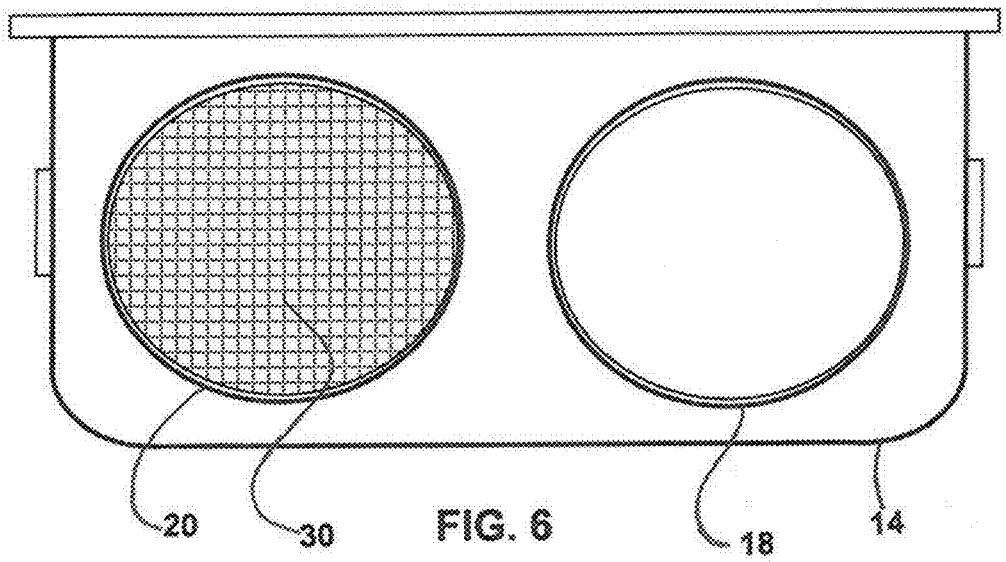
FIG. 6 is a top view of upper housing of FIG. 1.
Figure 7:
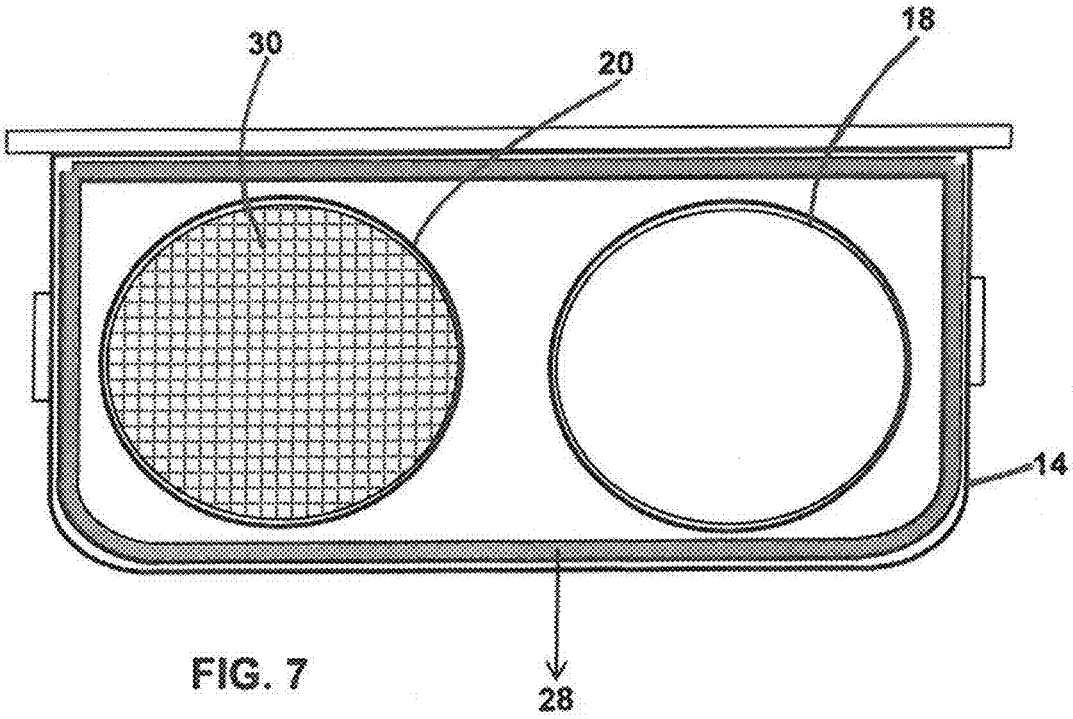
FIG. 7 is a bottom view of upper housing of FIG. 6.
Figure 8:
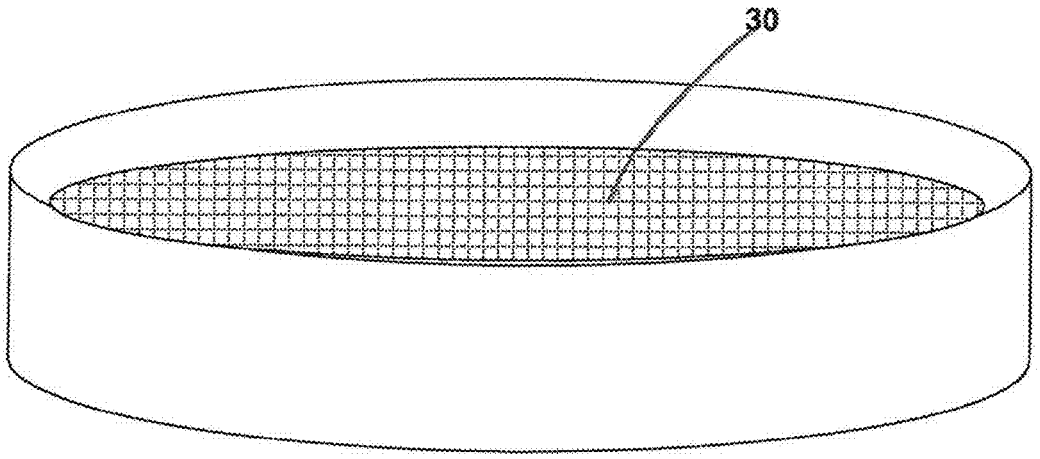
FIG. 8 is a perspective view of filter used in lint collector system of FIGS. 1 and 2.
Figure 9:
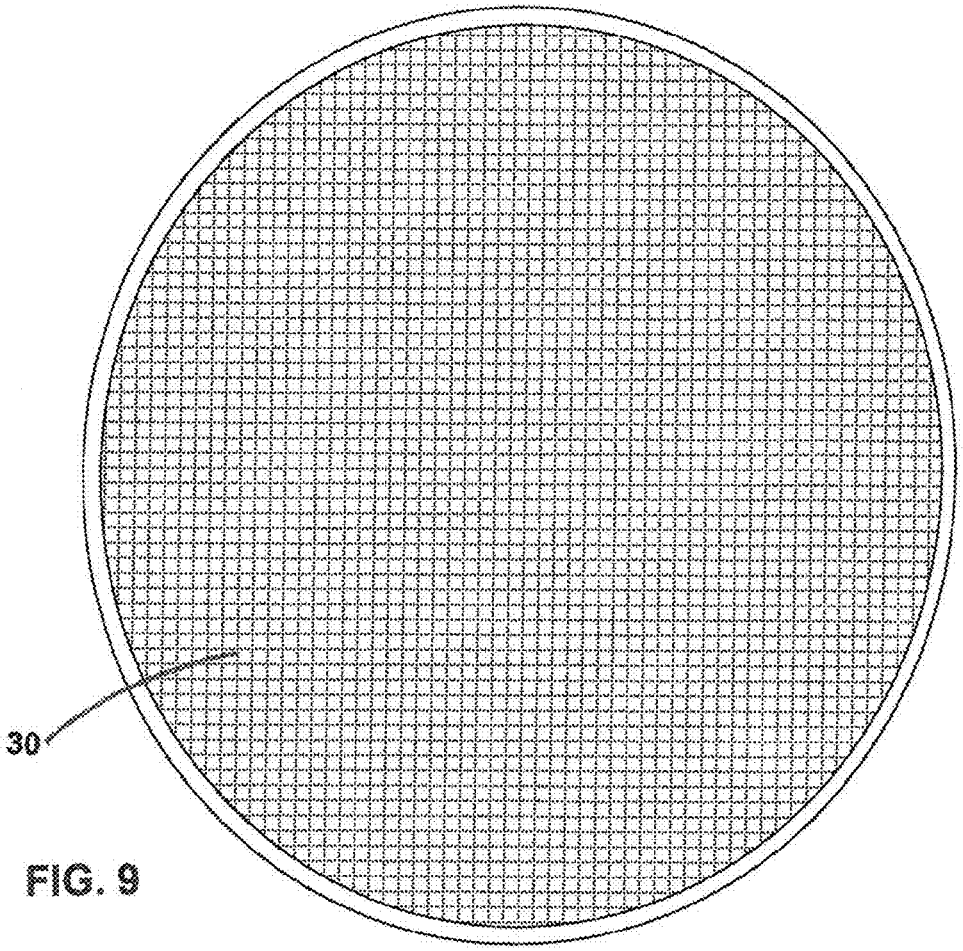
FIG. 9 is a top view of the filter shown in FIG. 8.
Figure 29:
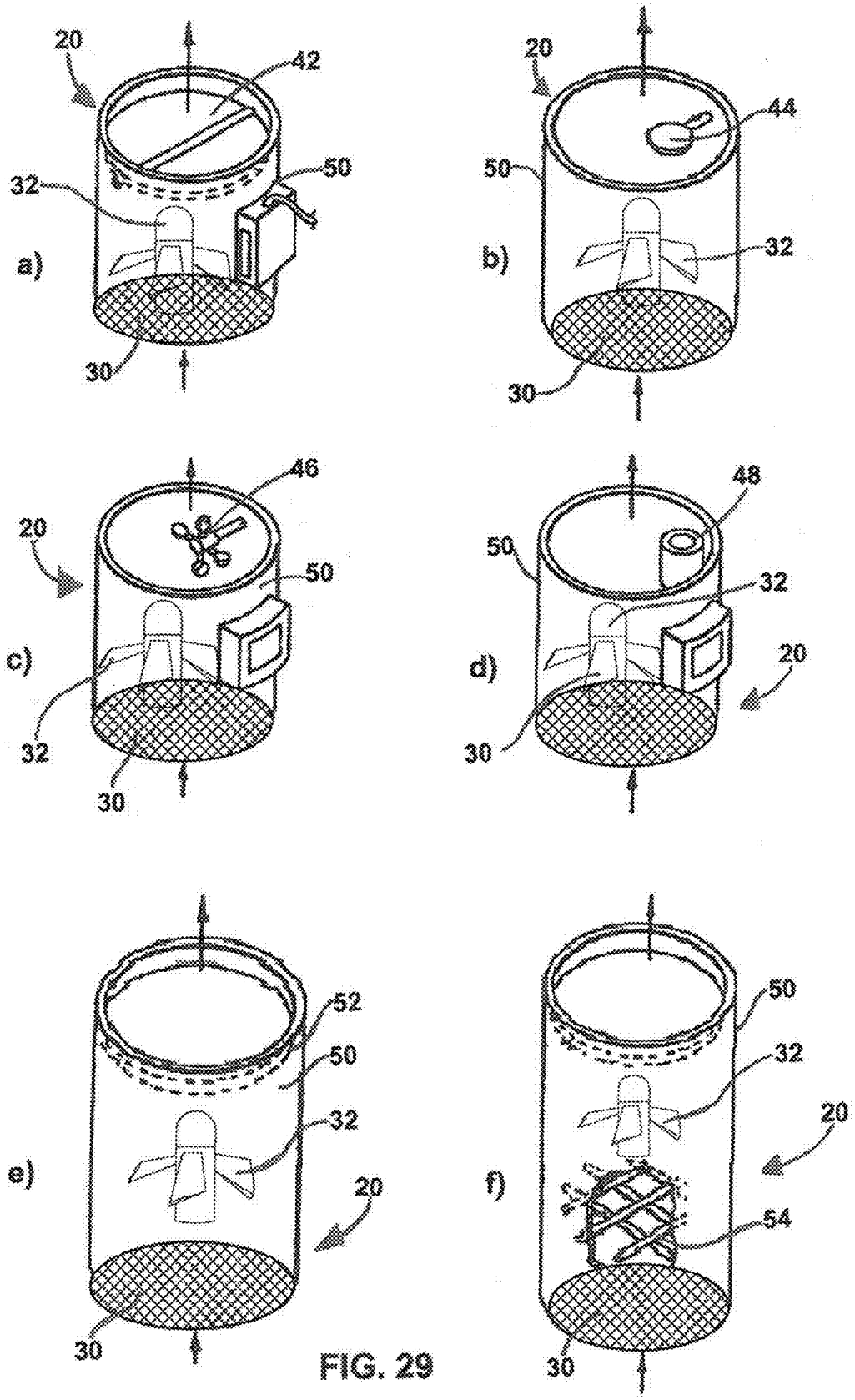
FIG. 29 *a*) to *f*) show perspective views of filter and fan assembly with a variety of different sensors therein.

The display 34 may be connected to one or more sensor. Some examples of sensors are shown in FIGS. 29 *a*) through *f*) but these sensors are by way of example only. Some sensors may be air flow sensors such a flapper type flow meter 42, vane type flow meter 44 or propeller type flow meter 46. Sensors may also be a pressure sensor 48 for measuring pressure in the outlet pipe 50. Sensors may also include a temperature sensor 52 or a sensor 54 to determine if the filter 30 is damaged. As well, lower housing 12 may include a water sensor 56 shown in FIG. 3. It will be appreciated that the use of sensors is optional and that if used some or all of these sensors may be used. Typically the sensors will be operably connected to the display 34.

Figure 11:
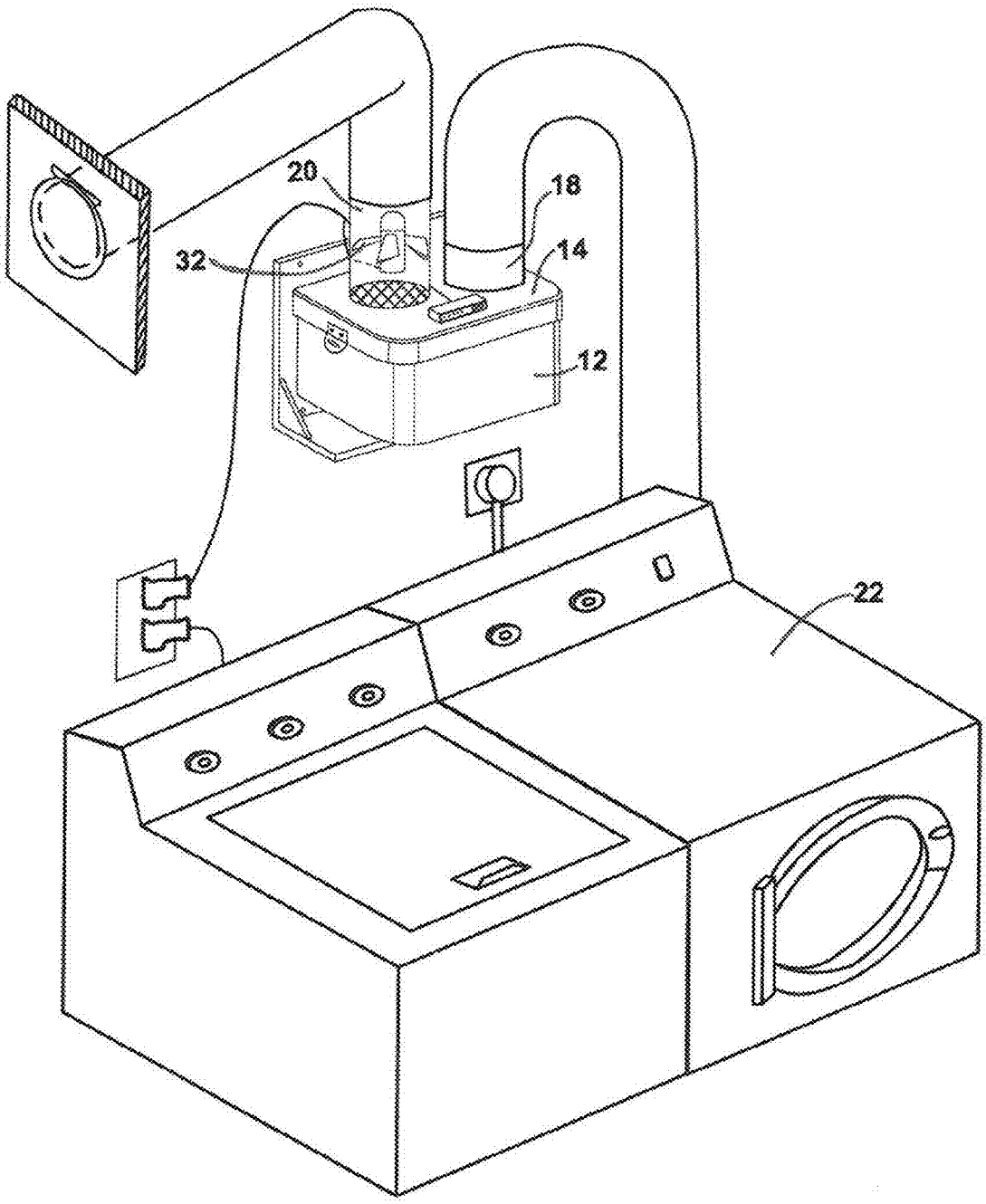
FIG. 11 is a perspective view of the lint collector system of FIG. 1 attached to a dryer similar to that shown in FIG. 10 but showing the lint collector system attached to a regular voltage plug.
Figure 12:
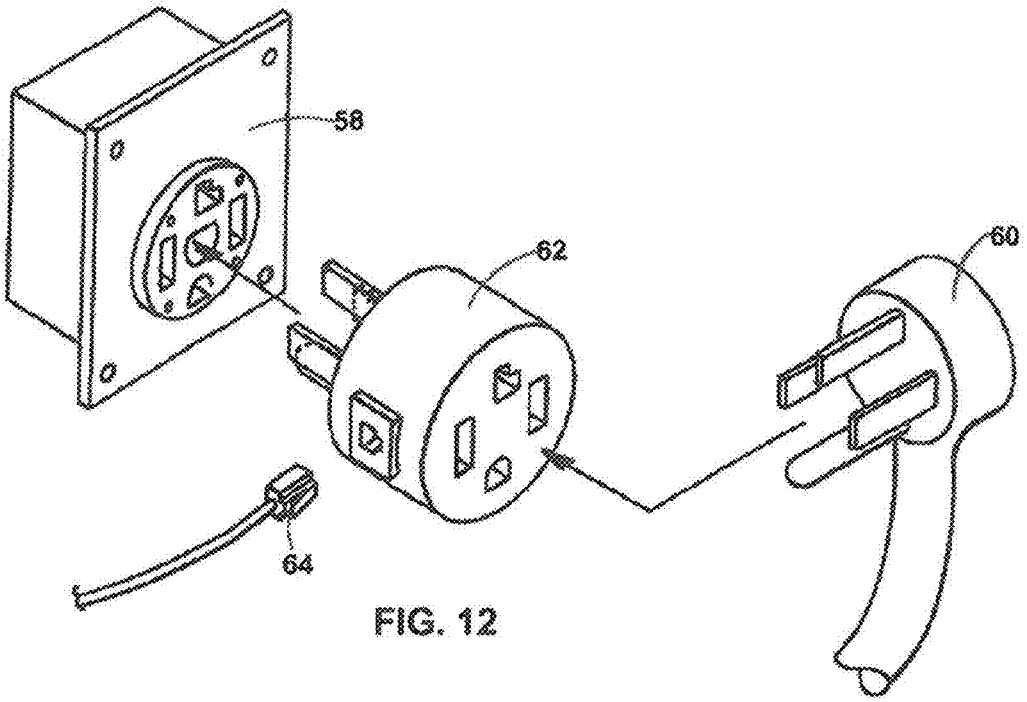
FIG. 12 is a perspective view of a plug system wherein the lint collector system uses a low voltage plug.
Figure 13:
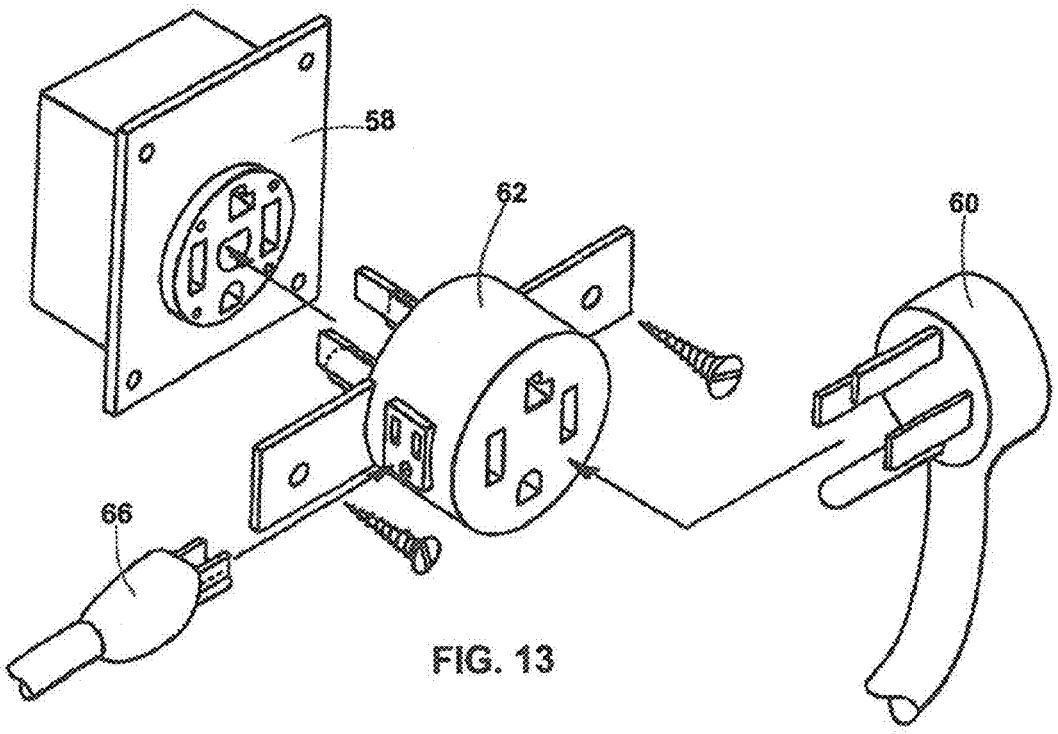
FIG. 13 is a perspective view of a plug system wherein the lint collector system uses a regular voltage plug.
Figure 14:
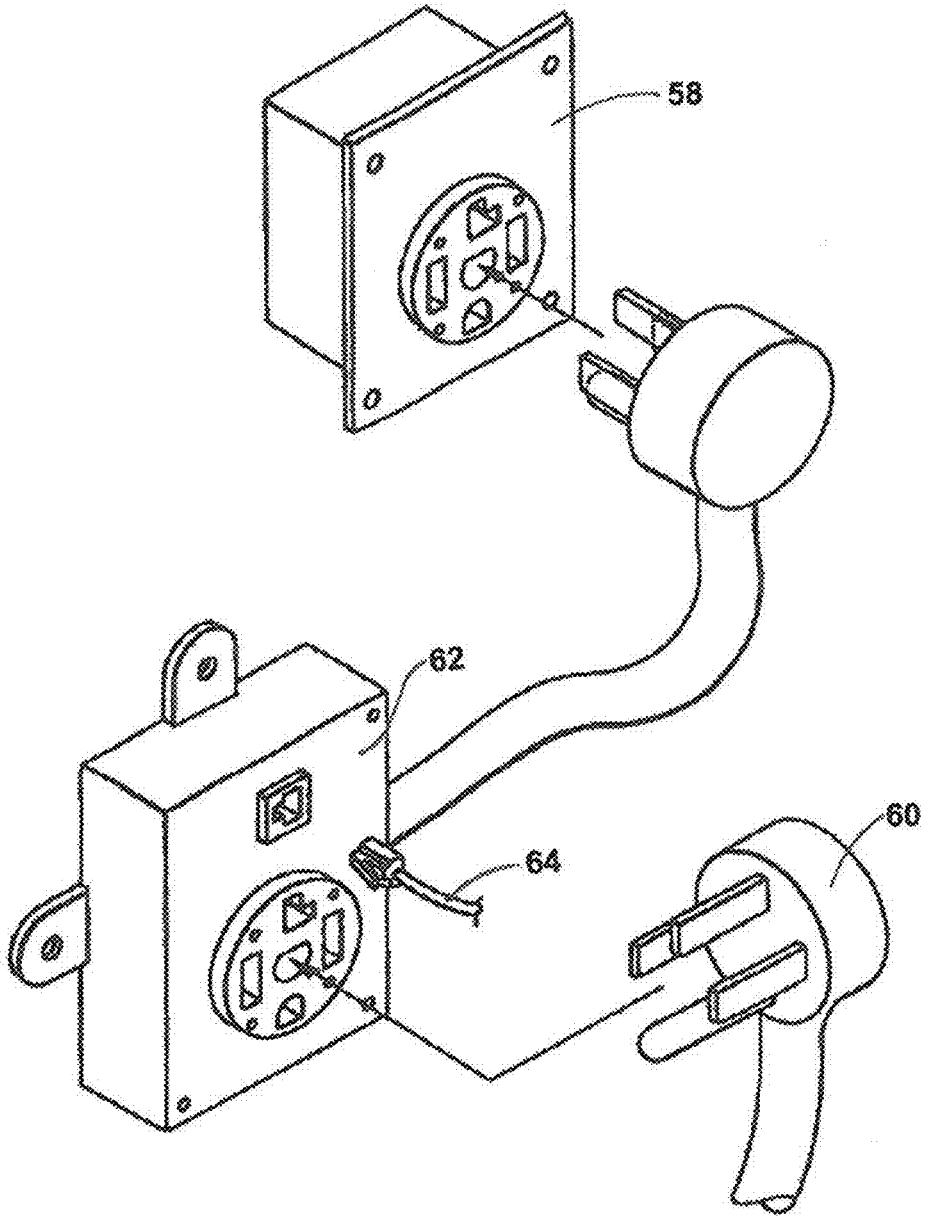
FIG. 14 is a perspective view of a plug system similar to that shown in FIG. 12 but configured differently and wherein the lint collector system uses a low voltage plug.
Figure 15:
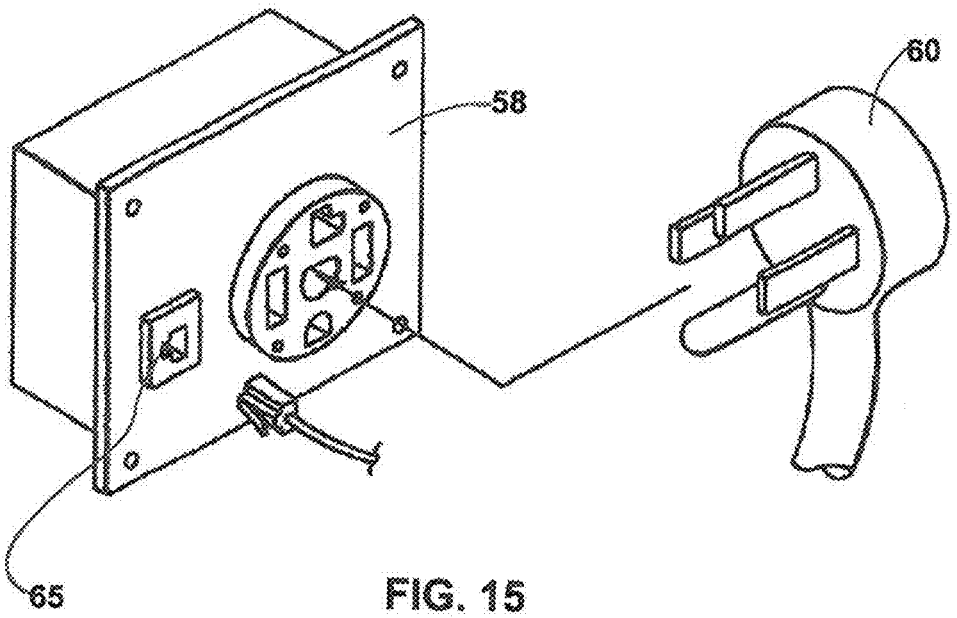
FIG. 15 is a perspective view of a conventional plug system wherein the lint collector system uses a low voltage jack.
Figure 16:
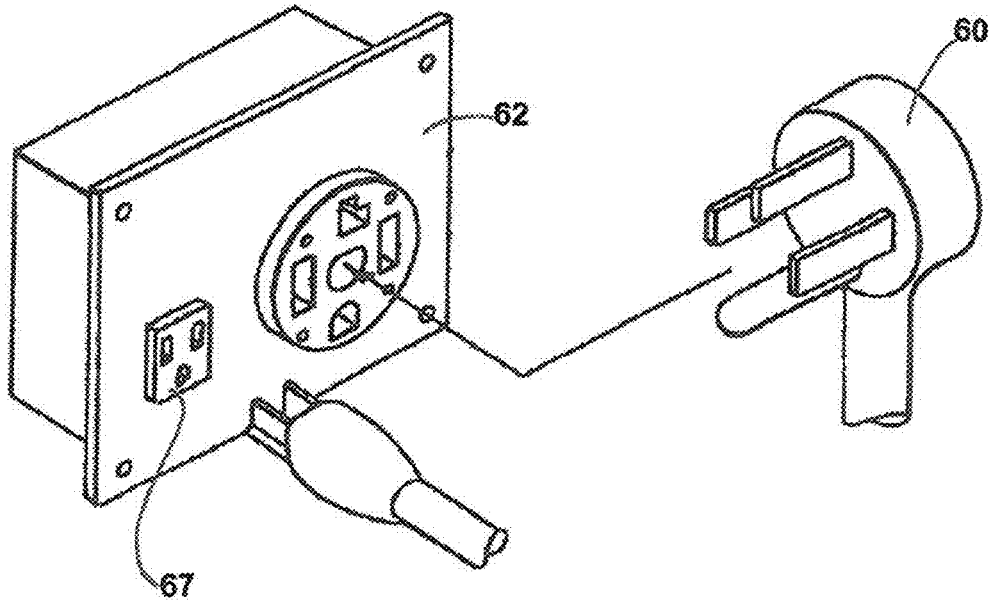
FIG. 16 is a perspective view of a conventional plug system wherein the lint collector system uses a regular voltage plug.

Preferably the dryer 22 is configured such that if the sensors are outside a predetermined value or range the electrical power to the clothes dryer will be shut down. This may be achieved by way of original equipment manufacturer (OEM) of the dryer including such electronics. Alternatively a plug adaptor 62 may be provided into which the dryer plug 60 is plugged and into which the lint collector system 10 is plugged such that power to the dryer is interrupted in response to a signal from the lint collector system 10. Plug adaptor 62 is adapted to be plugged into a conventional dryer plug receptacle 58. Alternatives of which are shown in FIGS. 12, 13 and 14. Alternatively, regular wall plug receptacle 67 or jack type receptacle may be installed proximate to the conventional dryer plug receptacle 58. Lint collector system 10 and fan 32 may run on a low voltage and be connected using a jack type plug 64 as shown in FIGS. 10 and 12. Alternatively lint collector system 10 and fan 32 may use a regular voltage and be connected by way of a regular plug 66 and shown in FIGS. 11 and 13.

Figure 17:
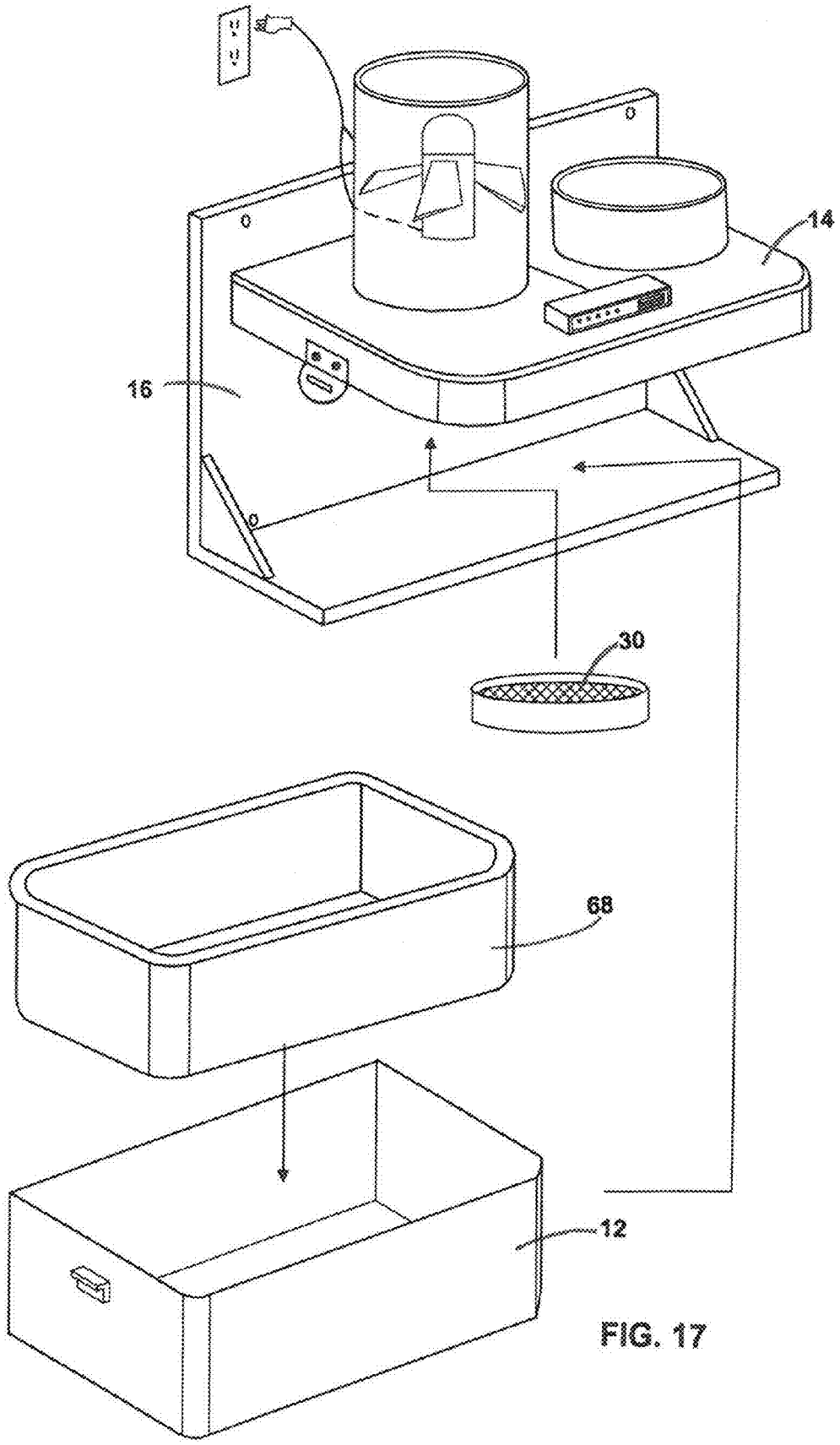
FIG. 17 is a blown apart perspective view of an alternate embodiment of the lint collector system including a disposable liner.

A variation of lint collector system 10 is shown in FIG. 17 wherein lint collector system 10 further includes a disposable liner 68 which fits into lower housing 12. Disposable liner 68 is somewhat similar to a disposable coffee filter.

Disposable liner 68 provides user with an easy way of removing and disposing of lint.

Figure 18:
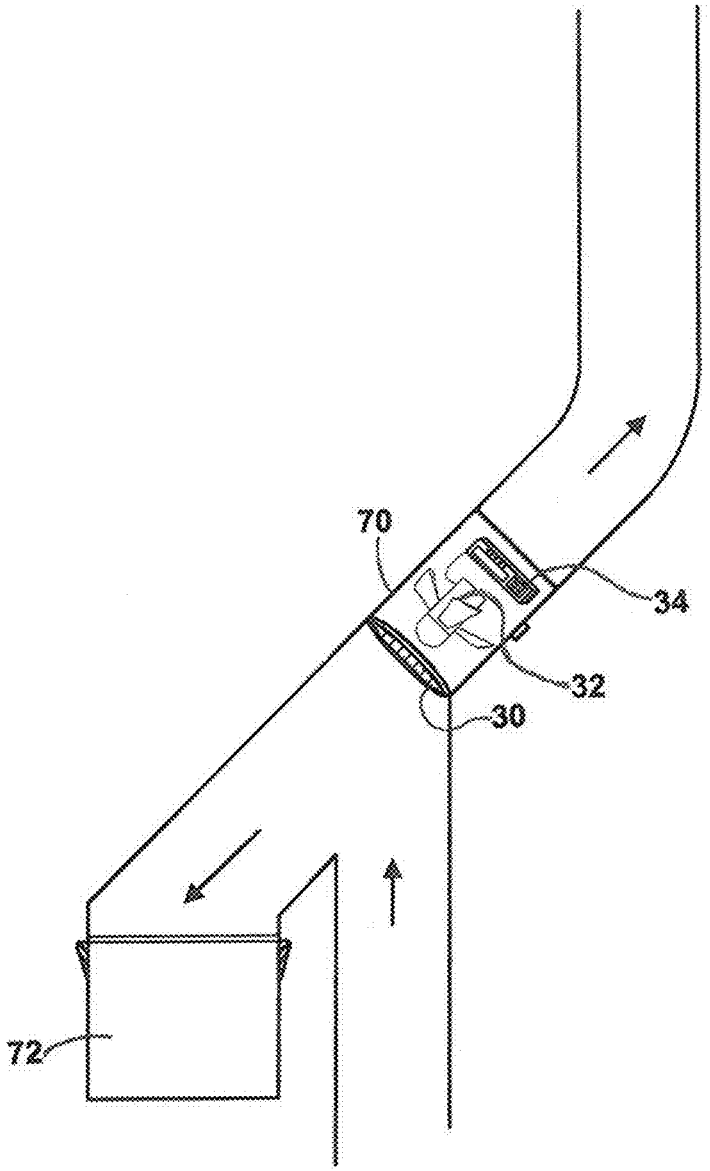
FIG. 18 is a side view of an alternate embodiment of the lint collector system.
Figure 19:
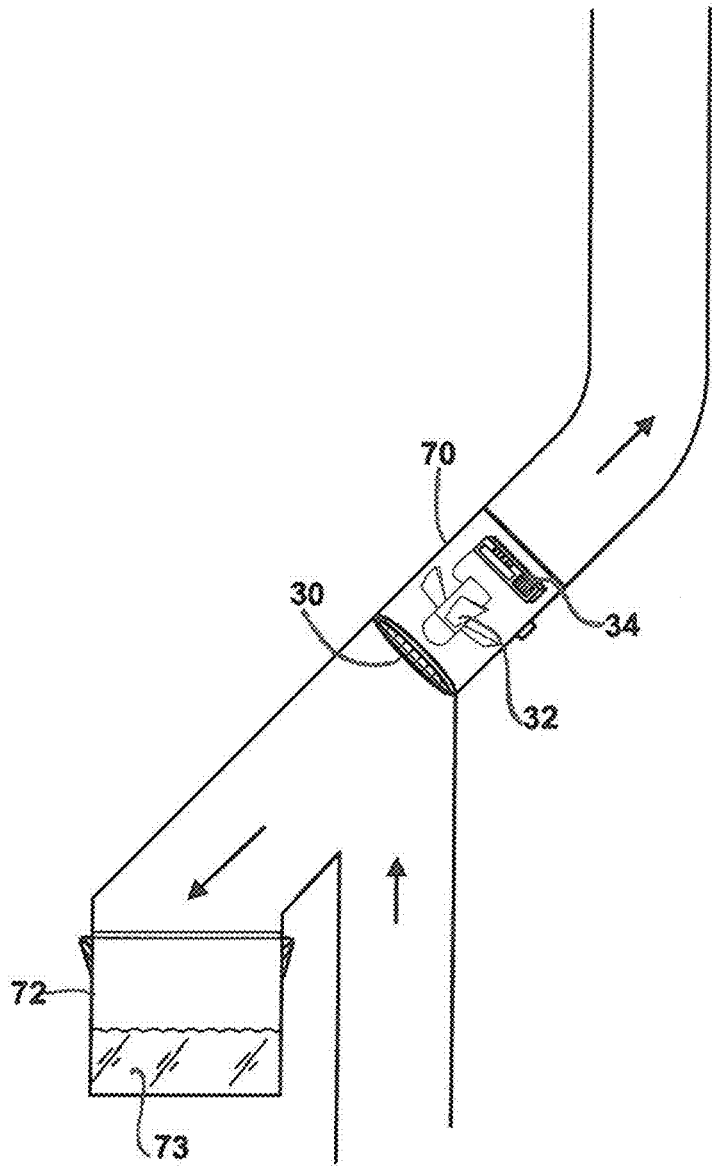
FIG. 19 is a side view of an alternate embodiment of the lint collector system, similar to that shown in FIG. 18 but showing liquid in the lint collector portion.
Figure 20:
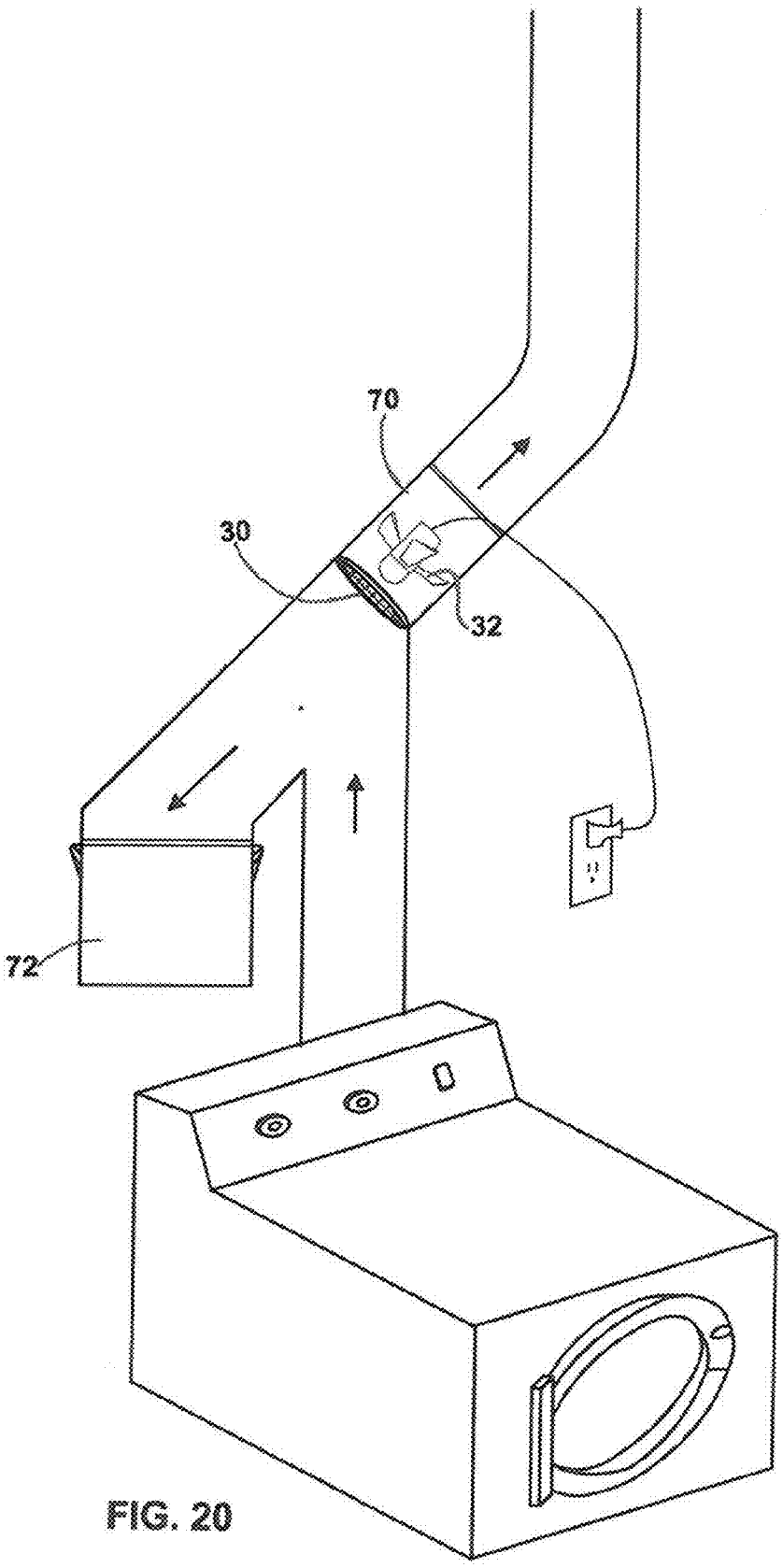
FIG. 20 is a side view of an alternate embodiment of the lint collector system, similar to that shown in FIG. 18 but showing the fan connected to a regular voltage plug.
Figure 21:
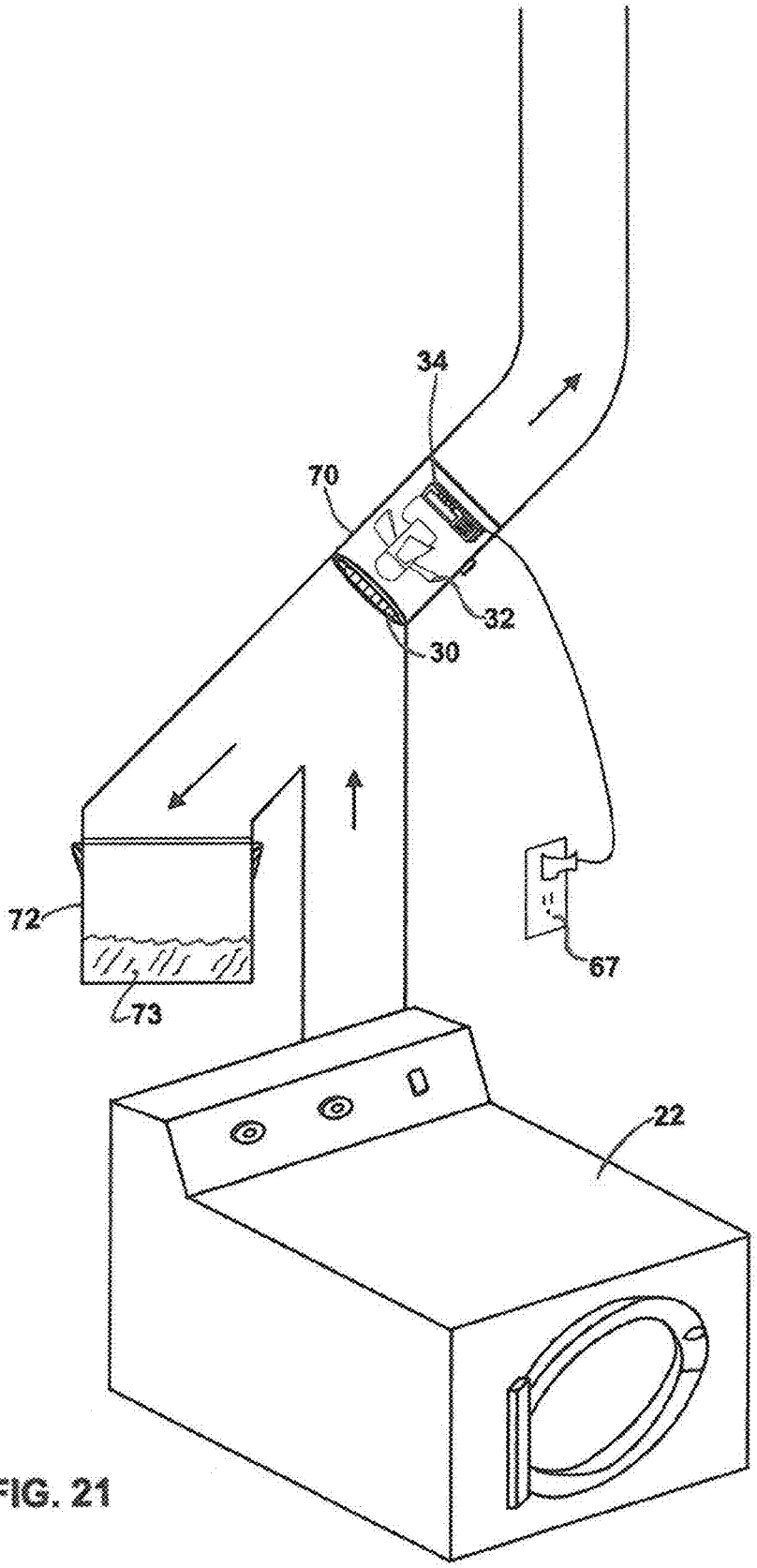
FIG. 21 is a side view of an alternate embodiment of the lint collector system, similar to that shown in FIG. 20 but showing a display screen.
Figure 22:
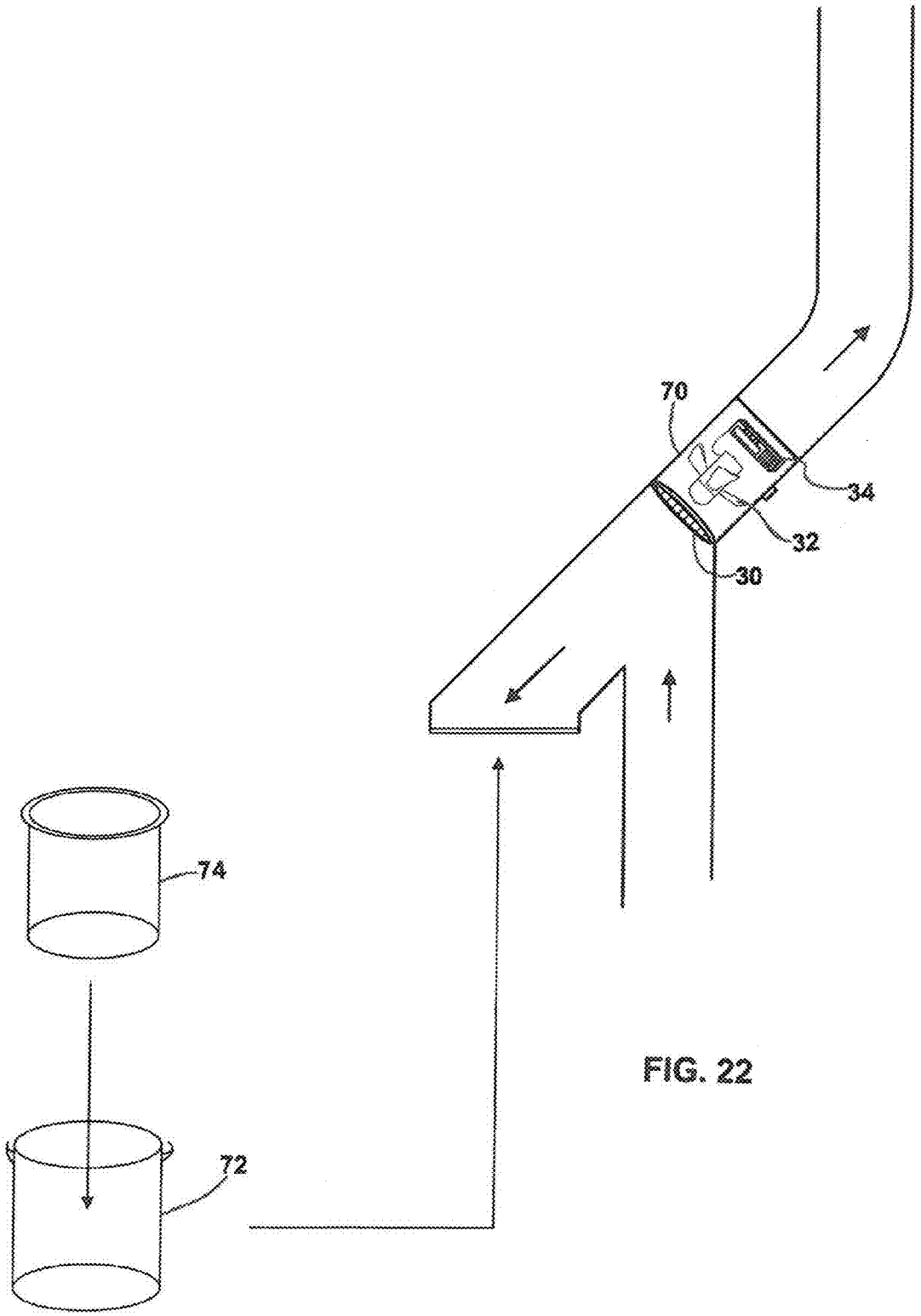
FIG. 22 is a side view of an alternate embodiment of the lint collector system, similar to that shown in FIG. 19 but showing a disposable liner for the lint collector portion.
Figure 23:
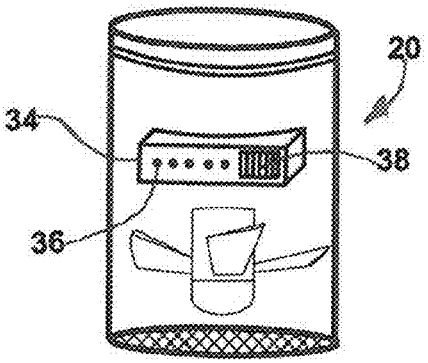
FIG. 23 is a side view of the filter and fan assembly with a display including audio and light indicators.
Figure 24:
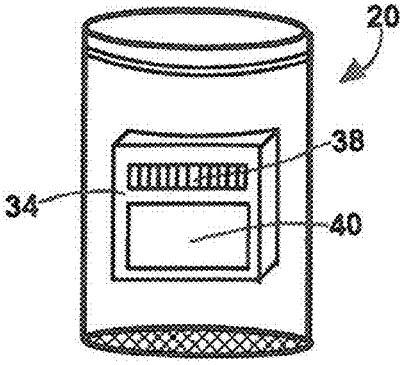
FIG. 24 is a side view showing a display including audio and a display screen.
Figure 25:
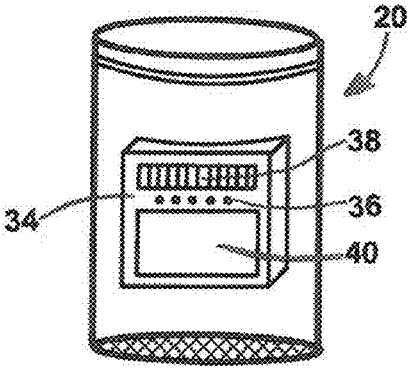
FIG. 25 is a side view showing a display including audio, light indicators and a display screen.
Figure 26:
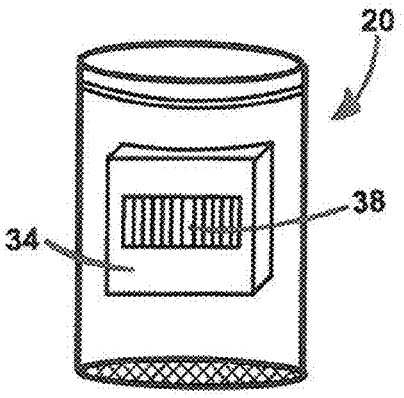
FIG. 26 is a side view showing a display including an audio indicator.

FIGS. 18 to 22 show alternate embodiments wherein the filter 30 and fan 32 are housed in an exhaust pipe insert 70. Preferably exhaust pipe insert 70 includes filter 30, fan 32 and display 34. Exhaust pipe insert 70 may be operably connected to sensors as described above and as shown in figures. Exhaust pipe insert 70 may connect to dryer plug as shown in FIGS. 18 and 19 or plugged in as shown in FIGS. 20 and 21. A receptacle 72 is provided proximate to the exhaust pipe insert such that when the fan 32 is activated to create back pressure lint or other debris that has collected on the filter 30 will be blown into receptacle 72. Receptacle 72 may have water 73 therein as shown in FIG. 19 or 21 or no water as shown in FIGS. 18 and 20. As well receptacle 72 may include a liner 74 as shown in FIG. 22. Receptacle 72 is removable so that it can be cleaned out when needed. Exhaust pipe insert 70 may be positioned anywhere in the exhaust pipe or alternatively close to the dryer 22 as shown in FIGS. 20 and 21.

Figure 27:
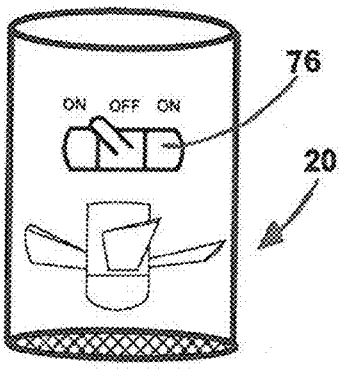
FIG. 27 is a side view showing a filter and fan assembly and an on and off switch.
Figure 28:
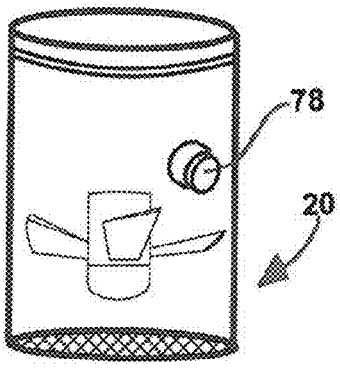
FIG. 28 is a side view showing a filter and fan assembly and a push button.
Figure 30A:
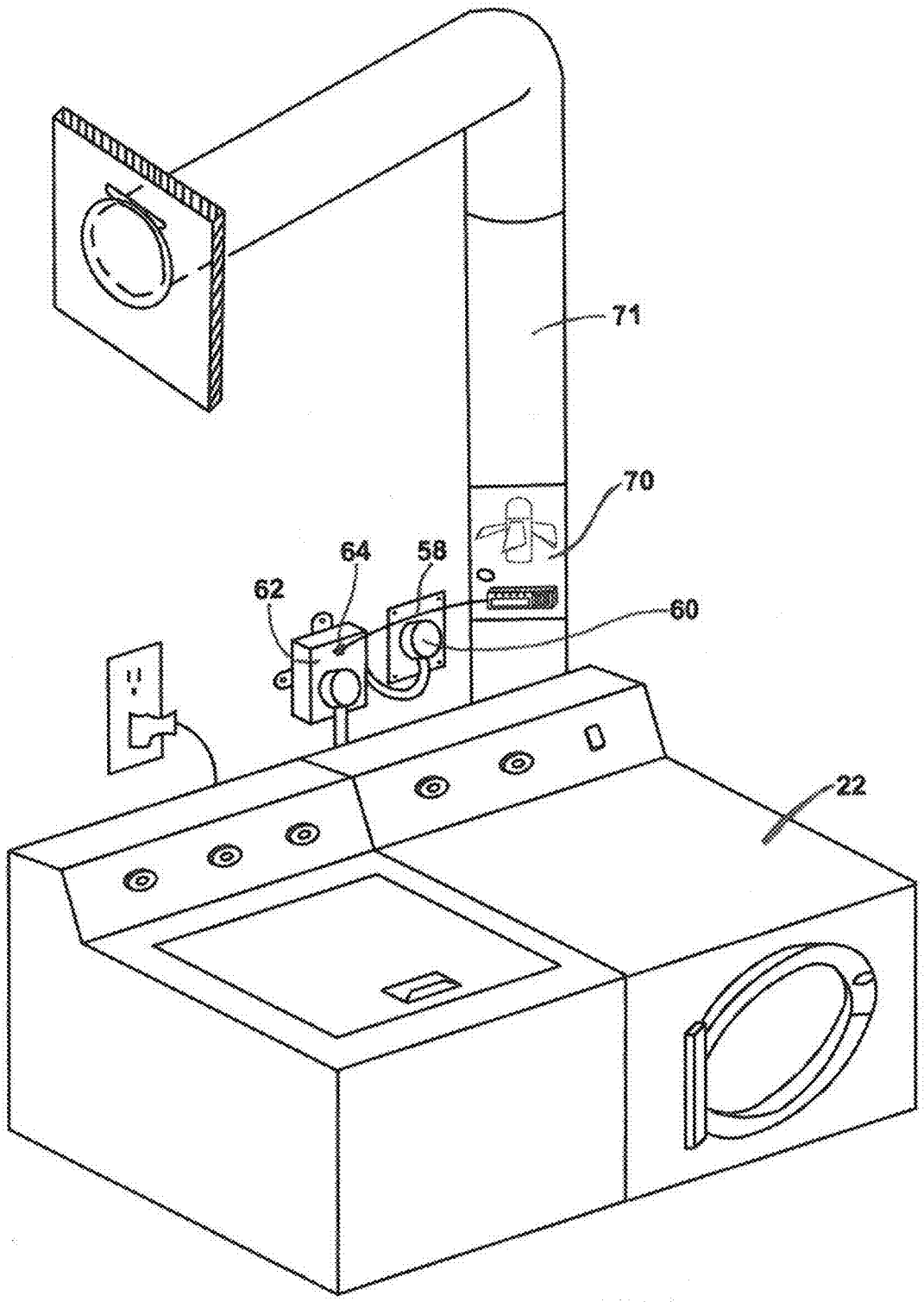
FIG. 30 *a*) to *c*) shows perspective views of alternate embodiments of an exhaust pipe insert that is connected to a dryer and connected to a plug adaptor a), a conventional plug through a remote display b) and conventional plug.
Figure 30B:
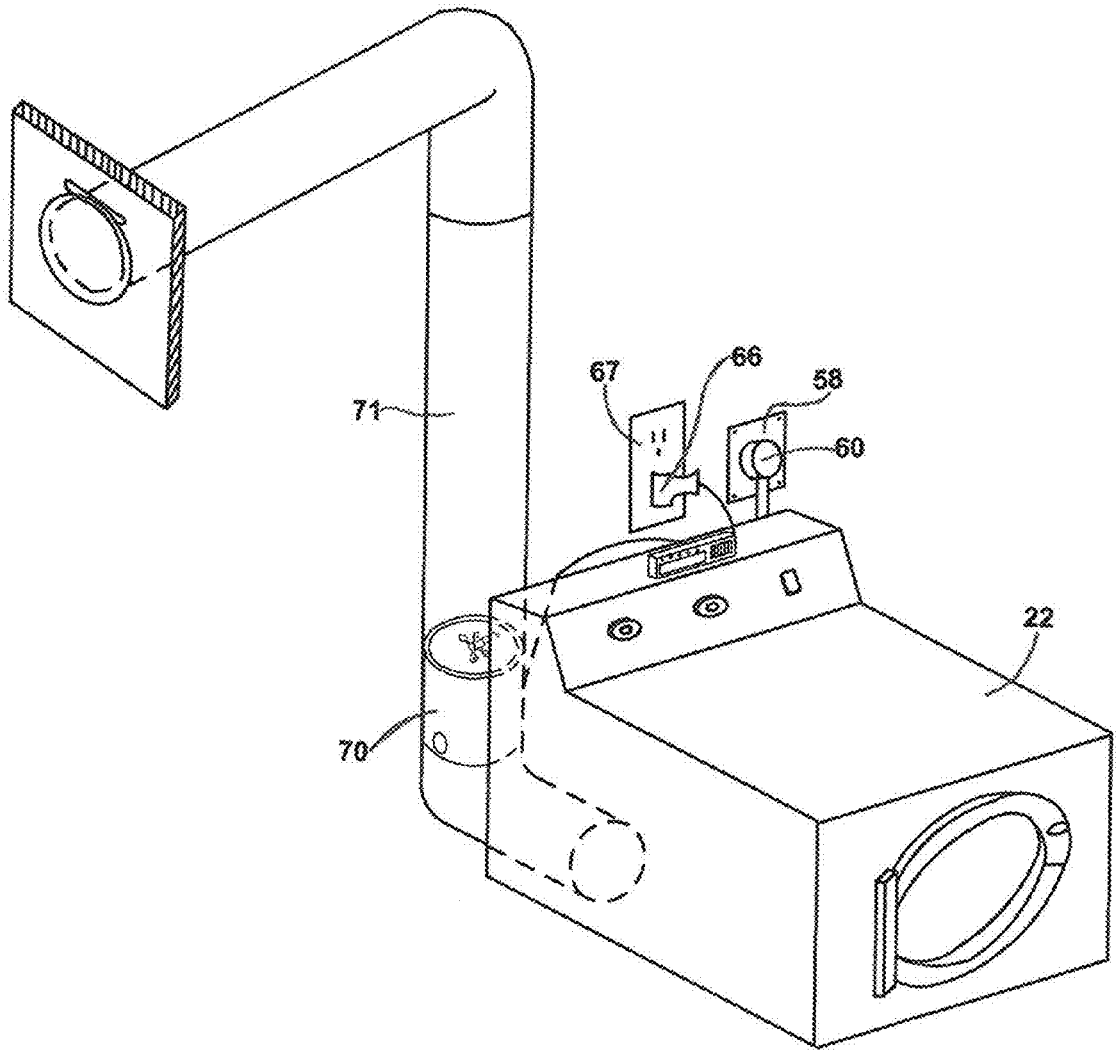
Figure 30C:
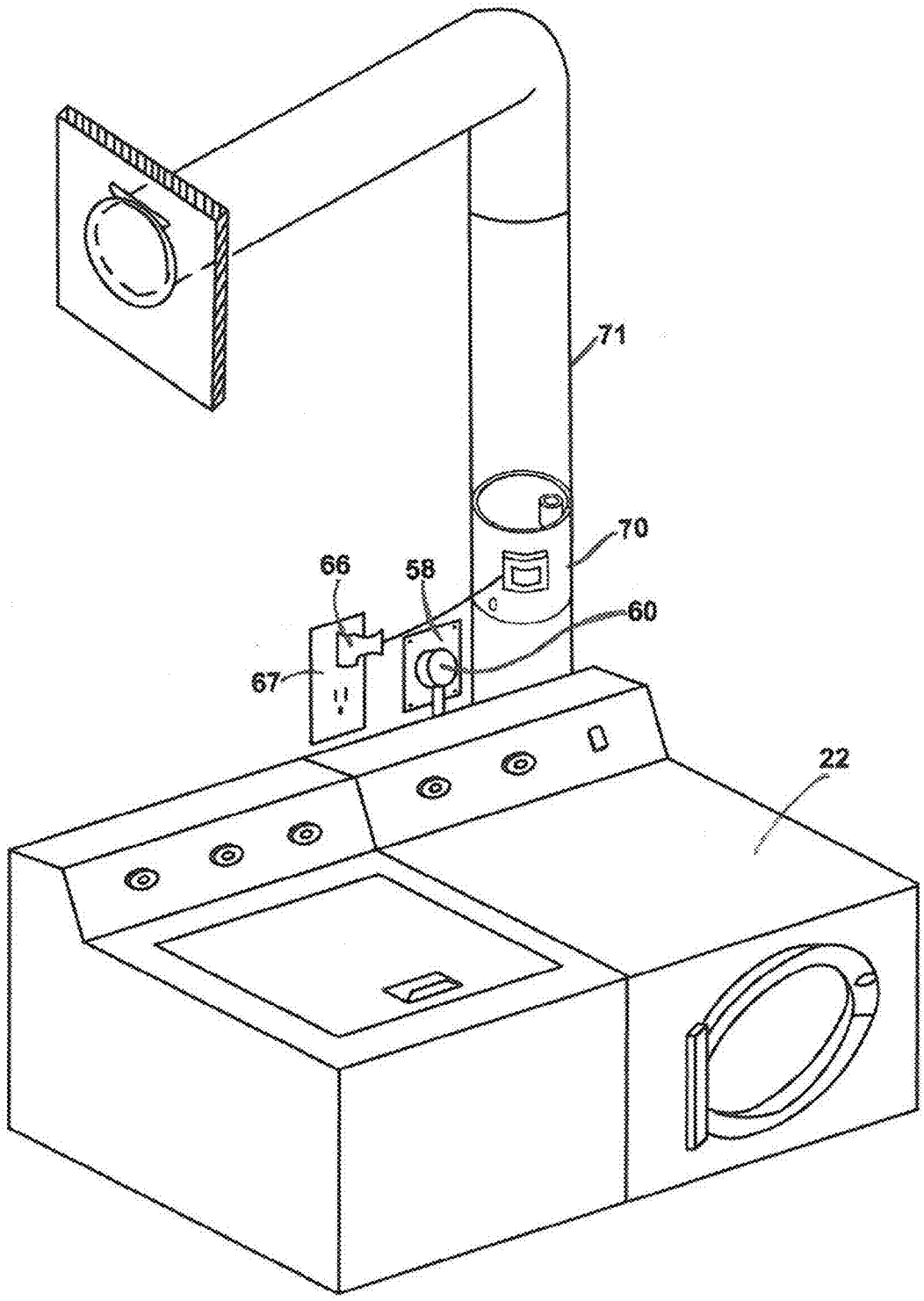
Figure 31:
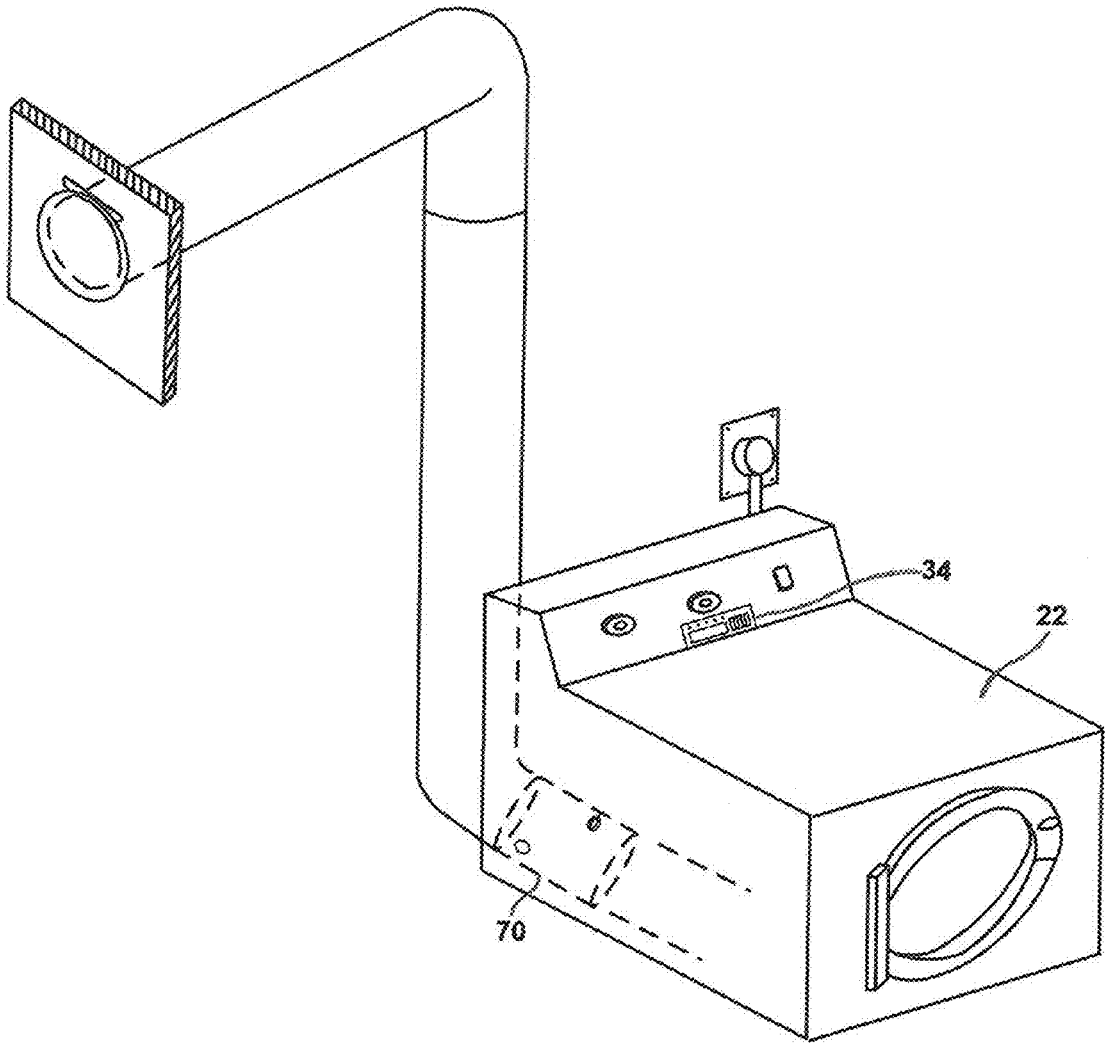
FIG. 31 is a perspective view of a dryer showing an exhaust insert as part of the dryer.

Alternate versions of outlet 20 and exhaust insert are shown in FIGS. 23 to 29. As shown in FIGS. 27 and 28 outlet 20 or exhaust pipe insert 70 may be provided with an on/off switch 76 or a push button 78 either of which will allow the user to manually turn on the fan to clear the filter 30. The exhaust pipe insert 70 may be installed in an external exhaust pipe 71 as shown in FIGS. 30 *a*) to *c*) or installed in a dryer 22 as shown in FIG. 31. The exhaust pipe insert 70 is operably connected to a display 34 and may be powered as described above.

Figure 32:
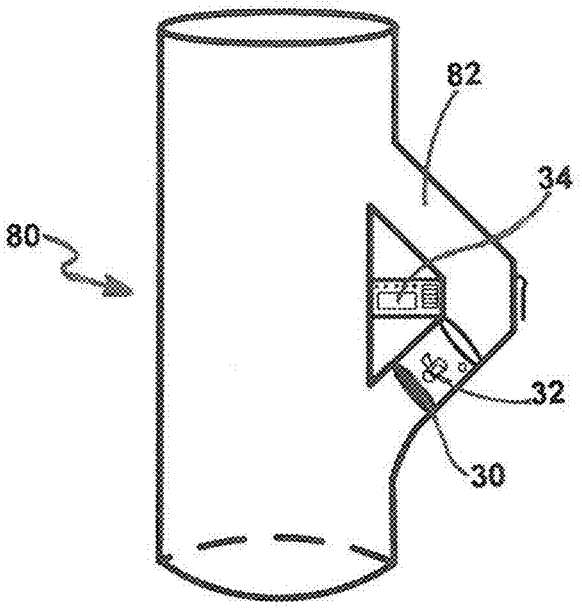
FIG. 32 is a perspective view of an alternate embodiment of exhaust pipe insert.
Figure 33:
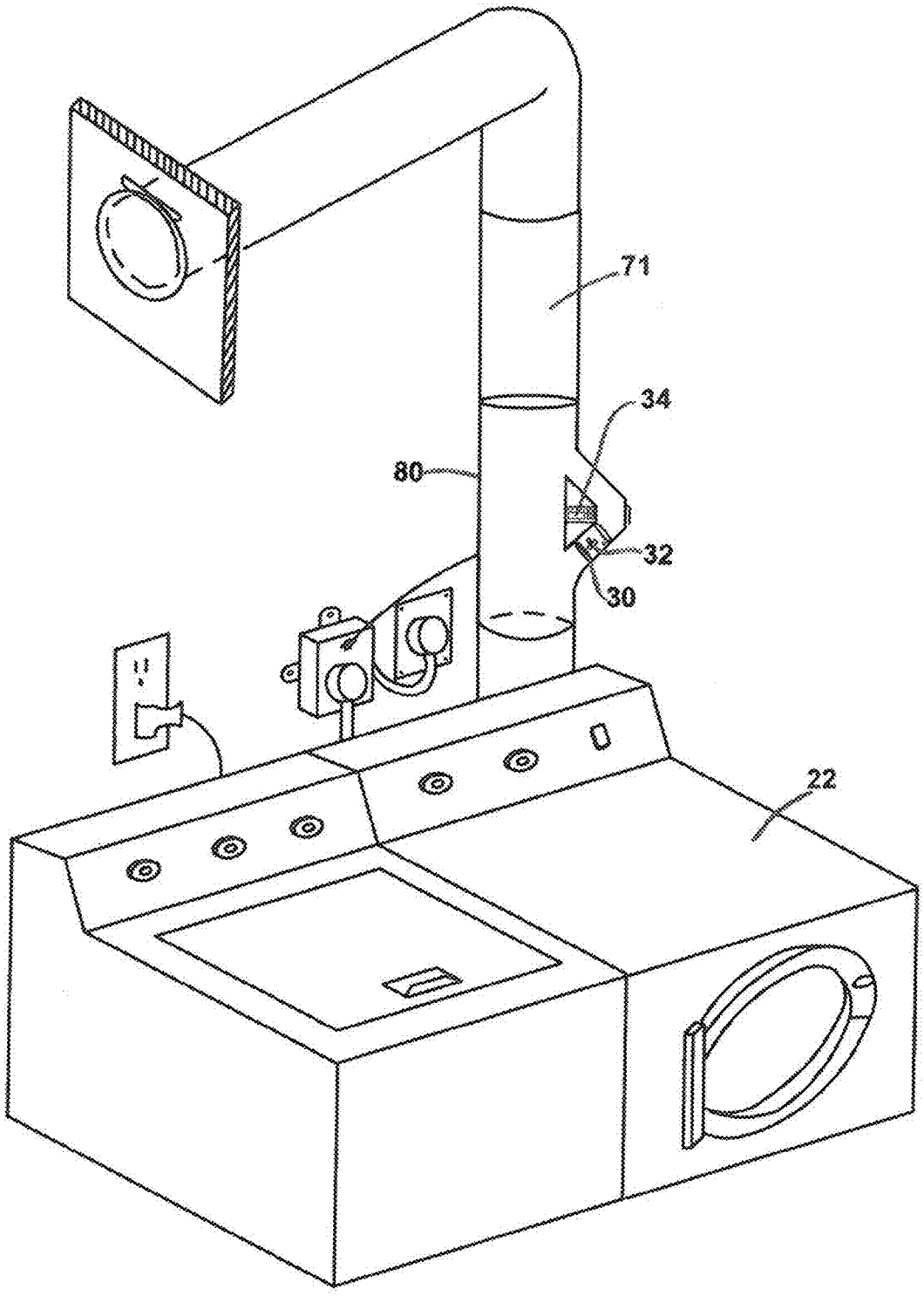
FIG. 33 is a perspective view of the exhaust pipe insert of FIG. 32 installed external to a dryer.
Figure 34:
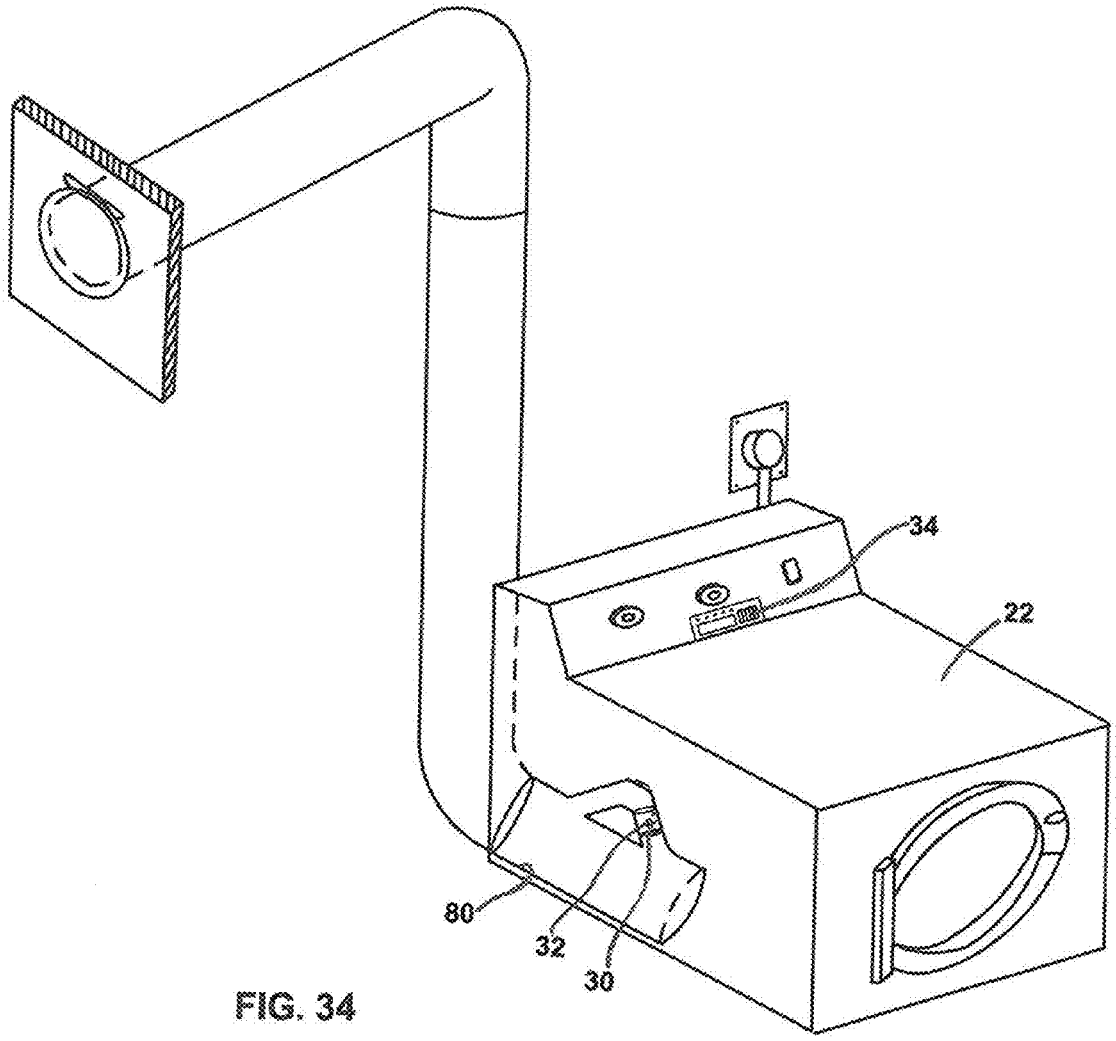
FIG. 34 is a perspective view of the exhaust pipe insert of FIG. 32 installed in a dyer.

An alternative version of pipe insert 80 is shown in FIG. 32 and shown in an external exhaust pipe 71 and in a dryer 22. Pipe insert 80 has an elbow 82 extending out from the general flow of the exhaust pipe. In this embodiment the fan 32 and the filter 32 are located in the elbow 82 and are operably connected to the display 34. Note this embodiment may be installed in an external exhaust pipe 71 as shown in FIG. 33 or located in a dryer 22 wherein the display 34 is proximate to the other controls on the dryer as shown in FIG. 34.

Preferably a small amount of water is used in the lower housing 12 to "prime" the lint collection. It has been observed that only a small amount of water is needed to prime the lint collection and that once there is a small amount of lint "caught" by the water that the new lint will tend to attach to the base of moist lint. Further it has been observed that this continues to be the case when the lint in the lower housing 12 appears to be moist. Further it has been observed that the lint over time will form a somewhat felt-like appearance and very surprisingly it has been observed that this felt-like mass is difficult to ignite and was shown to be self-extinguishing during some experiments. This is very surprising when contrasted to lint when collected on a filter or screen often forms a fire hazard.

It has been observed that while it is preferred that the lower housing 12 is primed with a small amount of water it will also work without any water since the lint in the dryer typically has some moisture therein.

It will be appreciated that this system may be considered a self-cleaning lint collection system or exhaust system. In at least one embodiment the system is configured such that if a measurement from flow meter in the outlet or exhaust pipe is below a predetermined level the fan is automatically active to clear the lint from the filter 30. Accordingly the fan is activated responsive to a measurement from the flow meter being below a predetermined level. Alternatively the fan may be activated responsive to a measurement from a pressure sensor being below a predetermined level. Alternatively or in addition the fan is manually activatable. Alternatively the fan is activated at predetermined times.

It will be appreciated that the lint collection system 10 may be retrofit into an existing dryer system or it may be manufactured by an OEM as part of their dryer system. Further the lint collection system may be the primary lint collection system or a secondary lint collection system which is used in addition to the internal lint screen in a dryer.

Generally speaking, the systems described herein are directed to lint collector systems. As required, embodiments of the present invention are disclosed herein. However, the disclosed embodiments are merely exemplary, and it should be understood that the invention may be embodied in many various and alternative forms. The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention. For purposes of teaching and not limitation, the illustrated embodiments are directed to lint collector systems.

As used herein, the terms "comprises" and "comprising" are to construed as being inclusive and opened rather than exclusive. Specifically, when used in this specification including the claims, the terms "comprises" and "comprising" and variations thereof mean that the specified features, steps or components are included. The terms are not to be interpreted to exclude the presence of other features, steps or components.

What is claimed as the invention is:

1. An exhaust system for use with a dryer, the system being a pipe outlet for a lint collection system, or for use in an exhaust pipe insert, the exhaust system comprising:

a filter removably positioned at a proximal end of the pipe outlet or within the exhaust pipe insert housed inside an exhaust ducting pipe, wherein the lint collection system is external to a dryer and the pipe outlet extends upwardly from an outer surface of the lint collection system, wherein the pipe outlet or the exhaust pipe insert has a transverse cross section and an axial direction, and the filter is dimensioned to cover the transverse cross section;

a fan located within the exhaust system downstream of the filter; and a receptacle, whereby activating the fan blows lint in the axial direction off the filter into the receptacle, thereby clearing the lint.

2. The exhaust system of claim 1 further including a flow meter and wherein the fan is activated responsive to a measurement from the flow meter being below a predetermined level.

3. The exhaust system of claim 1 further including a pressure sensor and wherein the fan is activated responsive to a measurement from the pressure sensor being below a predetermined level.

4. The exhaust system of claim 1 wherein the fan is manually activatable.

5. The exhaust system of claim 1 wherein the fan is activated at predetermined times.

6. The exhaust system of claim 1 further including a display.

7. The exhaust system of claim 6 wherein the display includes one of light indicators, and audio indicator and display screen and a combination thereof.

8. The exhaust system of claim 1 further including sensors and the sensors are chosen from a group consisting of flow meters, pressure sensors, temperatures sensors and water level sensors and a combination thereof.

9. The exhaust system of claim 8 wherein the exhaust system is operably connected to a dryer whereby if the sensors are outside of predetermined levels power to the dryer is interrupted.

10. The exhaust system of claim 1 wherein the exhaust system is the pipe outlet for a lint collection system comprising an upper and lower housing, wherein the pipe outlet is located in the upper housing, and wherein the lint collection system further includes an inlet located in the upper housing.

11. The exhaust system of claim 10 wherein the lower housing is primed with water.

12. The exhaust system of claim 11 further including a disposable liner for the lower housing.

13. The exhaust system of claim 1 wherein the receptacle is provided proximate to the filter for receiving lint from the filter after the fan has been activated.

14. The exhaust system of claim 13 wherein the receptacle is provided with water.

15. The exhaust system of claim 13 wherein the receptacle is provided with a disposable liner.

16. The exhaust system of claim 1 wherein the exhaust system is located in the exhaust pipe insert that includes an elbow extending out from a general flow of the exhaust pipe insert and the exhaust system is located in the elbow.

17. The exhaust system of claim 1 wherein the exhaust system is for use in the exhaust pipe insert located in an external exhaust pipe.

18. The exhaust system of claim 1 wherein the exhaust system is for use in the exhaust pipe insert located in an exhaust pipe passing through the dryer.

* * * * *